US011052005B2

(12) United States Patent
Childs et al.

(10) Patent No.: US 11,052,005 B2
(45) Date of Patent: Jul. 6, 2021

(54) PATIENT SUPPORT APPARATUS WITH HANDLES FOR PATIENT AMBULATION

(71) Applicant: Stryker Corporation, Kalamazoo, MI (US)

(72) Inventors: William Dwight Childs, Plainwell, MI (US); Kevin M. Patmore, Plainwell, MI (US)

(73) Assignee: Stryker Corporation, Kalamazoo, MI (US)

( * ) Notice: Subject to any disclaimer, the term of this patent is extended or adjusted under 35 U.S.C. 154(b) by 471 days.

(21) Appl. No.: 16/134,048

(22) Filed: Sep. 18, 2018

(65) Prior Publication Data

US 2019/0083338 A1 Mar. 21, 2019

Related U.S. Application Data

(60) Provisional application No. 62/560,335, filed on Sep. 19, 2017.

(51) Int. Cl.
*A61G 7/053* (2006.01)
*A61G 5/00* (2006.01)
(Continued)

(52) U.S. Cl.
CPC ..... *A61G 7/053* (2013.01); *A61G 5/006* (2013.01); *A61G 7/015* (2013.01); *A61G 7/16* (2013.01)

(58) Field of Classification Search
CPC ..... A61G 7/053; A61G 5/006; A61G 7/015; A61G 7/16
See application file for complete search history.

(56) References Cited

U.S. PATENT DOCUMENTS 3,281,141 A * 10/1966 Smiley ..... A61G 13/02 5/614
3,284,126 A * 11/1966 Piazza ..... A47C 17/163 296/20
(Continued)

FOREIGN PATENT DOCUMENTS

AU 783695 B2 11/2005
AU 2011232780 A1 4/2012
(Continued)

OTHER PUBLICATIONS

Stryker SA, "Prime TC Transport Chair Brochure", 2013, 5 pages.
(Continued)

*Primary Examiner* — Eric J Kurilla
(74) *Attorney, Agent, or Firm* — Howard & Howard Attorneys PLLC

(57) ABSTRACT

A patient support apparatus for use in ambulating a patient to a floor surface. A patient support deck is operatively attached to a base and has a seat section, a leg section, and a pair of foot sections. The patient support deck is operable between a bed configuration and a chair configuration. In the bed configuration, the seat section, leg section, and foot sections support the patient in a flat position. In the chair configuration, the seat section supports the patient in a seated position, the leg section is articulated adjacent to the floor surface, and the foot sections are articulated relative to the leg section and out of support of the patient. A handle to facilitate patient ambulation is coupled to each of the foot sections, and the handles are arranged to facilitate patient ambulation when the patient support deck is in the chair configuration.

20 Claims, 15 Drawing Sheets

(51) Int. Cl.
*A61G 7/015* (2006.01)
*A61G 7/16* (2006.01)

(56) References Cited

U.S. PATENT DOCUMENTS 3,932,903 A 1/1976 Adams et al.
RE28,754 E 3/1976 Cook et al.
4,064,574 A 12/1977 Schnitzler
4,175,263 A 11/1979 Triplett et al.
4,183,015 A 1/1980 Drew et al.
4,242,672 A 12/1980 Gault
4,641,387 A 2/1987 Bondy et al.
4,691,962 A 9/1987 Holdt
4,787,104 A 11/1988 Grantham
4,805,249 A 2/1989 Usman et al.
4,858,260 A * 8/1989 Failor ..... A61G 5/006 5/618
4,862,529 A 9/1989 Peck
4,959,878 A 10/1990 Essek
4,985,946 A 1/1991 Foster et al.
5,084,925 A 2/1992 Cook
5,134,737 A 8/1992 Wyman
5,154,186 A 10/1992 Laurin et al.
5,173,975 A 12/1992 Peterson
5,230,113 A 7/1993 Foster et al.
5,231,721 A 8/1993 Fish
5,299,334 A 4/1994 Gonzalez
5,337,430 A * 8/1994 Schlein ..... A47C 21/00 5/662
5,354,022 A 10/1994 Coonrod
5,398,357 A * 3/1995 Foster ..... A61G 7/015 5/619
5,411,044 A 5/1995 Andolfi
5,454,126 A 10/1995 Foster et al.
5,479,666 A 1/1996 Foster et al.
5,526,541 A 6/1996 Massey et al.
5,555,582 A 9/1996 Jerideau
5,577,279 A 11/1996 Foster et al.
5,680,661 A * 10/1997 Foster ..... A61G 7/0015 5/604
5,708,997 A 1/1998 Foster et al.
5,715,548 A 2/1998 Weismiller et al.
5,732,423 A 3/1998 Weismiller et al.
5,745,937 A 5/1998 Weismiller et al.
5,790,997 A 8/1998 Ruehl
5,842,237 A 12/1998 Hargest et al.
5,844,488 A 12/1998 Musick
5,916,085 A 6/1999 Wells
5,933,888 A 8/1999 Foster et al.
5,940,910 A 8/1999 Weismiller et al.
5,987,673 A 11/1999 Smith
6,009,570 A 1/2000 Hargest et al.
6,112,345 A 9/2000 Foster et al.
6,141,806 A 11/2000 Bobey et al.
6,163,903 A 12/2000 Weismiller et al.
6,182,310 B1 2/2001 Weismiller et al.
6,240,583 B1 6/2001 Brooke et al.
6,256,822 B1 7/2001 Weston et al.
6,336,235 B1 * 1/2002 Ruehl ..... A61G 7/00 297/354.13
6,374,436 B1 * 4/2002 Foster ..... A61G 7/0015 5/624
6,427,264 B1 8/2002 Metz et al.
6,430,763 B2 8/2002 Kosumsuppamala et al.
6,453,491 B1 9/2002 Wells et al.
6,536,056 B1 * 3/2003 Vrzalik ..... A61G 7/015 5/613
6,539,569 B2 4/2003 O'Connell
6,584,628 B1 7/2003 Kummer et al.
6,629,326 B2 10/2003 Rabe
6,640,360 B2 11/2003 Hornbach et al.
6,694,548 B2 2/2004 Foster et al.
6,701,545 B1 3/2004 Ferneau et al.
6,715,784 B2 4/2004 Koerlin et al.
6,725,474 B2 4/2004 Foster et al.
6,820,293 B2 11/2004 Alverson
6,829,793 B2 12/2004 Brooke et al.
6,928,673 B2 8/2005 Risk, Jr.
6,941,598 B2 9/2005 Ferrand et al.
6,971,132 B2 12/2005 Feinsod
6,978,501 B2 12/2005 Vrzalik
7,000,272 B2 2/2006 Allen et al.
7,058,999 B2 6/2006 Horitani et al.
7,073,219 B2 7/2006 Poulin et al.
7,197,779 B2 4/2007 Shalikar
7,200,882 B2 4/2007 Heimbrock
7,213,279 B2 5/2007 Weismiller et al.
7,251,845 B2 8/2007 Schaller et al.
7,253,366 B2 8/2007 Bhai
7,319,386 B2 1/2008 Collins, Jr. et al.
7,406,731 B2 8/2008 Menkedick et al.
7,415,740 B1 8/2008 Kemper
7,430,770 B2 10/2008 Ramirez
7,458,119 B2 12/2008 Hornbach et al.
7,520,006 B2 4/2009 Menkedick et al.
7,520,009 B1 4/2009 Heck
7,559,101 B2 7/2009 Vrzalik et al.
7,568,247 B2 8/2009 Strobel et al.
7,673,353 B1 3/2010 Khodabandeh
7,690,059 B2 4/2010 Lemire et al.
7,694,368 B2 4/2010 Lewis, Jr.
7,716,762 B2 5/2010 Ferraresi et al.
7,761,939 B2 7/2010 Wiggins et al.
7,761,942 B2 7/2010 Benzo et al.
7,784,128 B2 8/2010 Kramer
7,788,747 B2 9/2010 Kramer et al.
7,788,748 B2 9/2010 Wurdeman
7,805,782 B2 10/2010 Hakamiun et al.
7,845,034 B2 12/2010 Kim
7,886,379 B2 2/2011 Benzo et al.
7,905,242 B2 3/2011 Kline
7,917,978 B2 4/2011 Ruschke et al.
8,042,206 B2 10/2011 Genaro
8,065,764 B2 11/2011 Kramer
8,104,118 B2 1/2012 Derenne et al.
RE43,155 E 2/2012 Allen et al.
8,117,696 B2 * 2/2012 Wernqvist ..... A61G 7/16 5/618
8,127,380 B2 3/2012 Wurdeman
8,156,586 B2 4/2012 Reed et al.
RE43,532 E 7/2012 Menkedick et al.
8,239,983 B2 8/2012 Chinn
8,272,087 B2 9/2012 Westermann
8,296,884 B2 10/2012 Heimbrock
8,336,133 B2 12/2012 Palay et al.
8,336,134 B2 12/2012 Jelinek
8,341,779 B2 1/2013 Hornbach et al.
8,353,071 B2 1/2013 Turner et al.
8,413,270 B2 4/2013 Turner et al.
8,413,273 B2 4/2013 Hornbach et al.
8,413,274 B2 4/2013 Weismiller et al.
8,453,283 B2 6/2013 O'Keefe
8,474,072 B2 7/2013 O'Keefe et al.
8,474,921 B2 7/2013 Newkirk et al.
8,495,774 B2 7/2013 Soltani
8,516,637 B2 8/2013 Karwal et al.
8,522,379 B2 9/2013 Turner
8,578,531 B2 11/2013 Abemathey et al.
8,631,524 B2 1/2014 Derenne et al.
8,640,285 B2 2/2014 Heimbrock et al.
8,646,124 B2 2/2014 Stryker et al.
8,677,535 B2 3/2014 Turner
8,689,376 B2 4/2014 Becker et al.
8,713,727 B2 5/2014 Heimbrock et al.
8,732,875 B2 5/2014 O'Keefe
8,745,786 B2 6/2014 Andrienko et al.
8,756,735 B2 6/2014 Heimbrock et al.
8,793,824 B2 8/2014 Poulos et al.
8,826,475 B2 9/2014 Jackson
8,844,075 B2 9/2014 Heimbrock
8,844,078 B2 9/2014 Hornbach et al.
8,863,331 B2 10/2014 Valentino et al.
8,887,329 B2 11/2014 Soltani
8,910,329 B2 12/2014 Turner et al.

(56) References Cited

U.S. PATENT DOCUMENTS 8,959,680 B2 2/2015 Tesar et al.
8,959,681 B2 2/2015 Richards
8,973,186 B2 3/2015 Bhai
8,973,187 B2 3/2015 Hornbach
9,013,313 B2 4/2015 Paine
9,038,214 B2 5/2015 Hardin
9,079,089 B2 7/2015 Lokken et al.
9,125,758 B2 9/2015 Skreosen
9,125,785 B2 9/2015 Trees
9,138,173 B2 9/2015 Penninger et al.
9,149,403 B2 10/2015 Turner et al.
9,173,797 B2 11/2015 Andrienko
9,179,863 B2 11/2015 Brauers et al.
9,216,123 B2 12/2015 Tekulve
9,253,891 B2 2/2016 Williams
9,265,677 B2 2/2016 Manouchehri et al.
9,277,827 B2 3/2016 Hornbach et al.
9,329,076 B2 5/2016 Meyer et al.
9,552,714 B2 1/2017 Ribble et al.
9,978,244 B2 5/2018 Ribble et al.
2003/0079289 A1* 5/2003 Vrzalik ..... A61G 7/0507 5/618
2003/0093863 A1* 5/2003 Grove ..... A61G 7/053 5/618
2003/0167568 A1 9/2003 Brooke
2004/0019967 A1 2/2004 Gant
2004/0074414 A1 4/2004 Phillips
2004/0158923 A1 8/2004 Perez et al.
2005/0011006 A1 1/2005 Ellen et al.
2005/0120485 A1* 6/2005 Sebastien ..... A61G 7/053 5/662
2005/0235418 A1 10/2005 Jacques et al.
2006/0053555 A1 3/2006 Poulos et al.
2006/0085914 A1 4/2006 Peterson et al.
2007/0038155 A1 2/2007 Kelly et al.
2007/0089238 A1 4/2007 Kramer et al.
2007/0169269 A1 7/2007 Wells
2009/0044334 A1 2/2009 Parsell et al.
2009/0094745 A1 4/2009 Benzo et al.
2009/0126114 A1 5/2009 Kral et al.
2010/0005592 A1 1/2010 Poulos et al.
2010/0017964 A1 1/2010 Kruse
2010/0064439 A1 3/2010 Soltani
2010/0170041 A1 7/2010 Heimbrock et al.
2010/0212087 A1 8/2010 Leib et al.
2010/0229299 A1 9/2010 Lear
2010/0242176 A1* 9/2010 Newkirk ..... A61G 7/0524 5/602
2011/0010861 A1* 1/2011 Heimbrock ..... A61G 7/053 5/618
2011/0068932 A1 3/2011 Flocard et al.
2011/0143898 A1* 6/2011 Trees ..... A63B 23/0405 482/142
2011/0314602 A1 12/2011 Stryker et al.
2012/0023670 A1 2/2012 Zerhusen et al.
2012/0096644 A1 4/2012 Heimbrock
2012/0102655 A1* 5/2012 Zerhusen ..... A61G 7/0513 5/662
2012/0110741 A1 5/2012 Mears et al.
2012/0117732 A1 5/2012 O'Keefe
2012/0124745 A1 5/2012 Heimbrock et al.
2012/0124746 A1* 5/2012 Andrienko ..... A61G 7/0514 5/618
2012/0137439 A1 6/2012 Heimbrock
2012/0137440 A1 6/2012 Richards
2012/0144588 A1 6/2012 Heimbrock et al.
2012/0198622 A1* 8/2012 Heimbrock ..... A61G 7/0513 5/600
2012/0198626 A1 8/2012 Richards
2012/0198628 A1 8/2012 Richards
2012/0204351 A1 8/2012 Revenus et al.
2012/0246830 A1* 10/2012 Hornbach ..... A61G 7/015 5/619
2012/0299353 A1* 11/2012 Griswold ..... A61G 7/002 297/354.1
2013/0086746 A1 4/2013 Vanderpohl
2013/0125310 A1 5/2013 Manouchehri
2013/0212807 A1 8/2013 Manson et al.
2014/0123389 A1* 5/2014 Hornbach ..... A61G 7/0507 5/611
2014/0137328 A1* 5/2014 Ohta ..... A61G 7/015 5/611
2014/0191541 A1* 7/2014 Ohta ..... A61G 5/128 297/118
2014/0265497 A1 9/2014 Hough et al.
2014/0313030 A1 10/2014 Ten Kate et al.
2014/0331410 A1 11/2014 Heimbrock et al.
2014/0333440 A1 11/2014 Kiani
2014/0343889 A1 11/2014 Ben Shalom et al.
2015/0135440 A1 5/2015 Chiacchira et al.
2015/0164722 A1 6/2015 Roussy et al.
2015/0231010 A1 8/2015 Nilsson et al.
2015/0238123 A1 8/2015 Yakam et al.
2015/0297432 A1 10/2015 Poulos et al.
2015/0305955 A1 10/2015 Simmonds et al.
2015/0320625 A1 11/2015 White
2016/0022039 A1 1/2016 Paul et al.
2016/0120717 A1 5/2016 Wurdeman
2016/0193095 A1 7/2016 Roussy et al.
2016/0213538 A1 7/2016 S Lus
2016/0302985 A1 10/2016 Tessmer et al.
2016/0310336 A1 10/2016 Ertelt
2016/0310340 A1 10/2016 Heidingsfelder-Bongard et al.
2016/0367420 A1 12/2016 Zerhusen et al.
2017/0056262 A1 3/2017 Yamada et al.
2017/0124844 A1 5/2017 Huster et al.
2017/0128295 A1 5/2017 Tekulve
2017/0172829 A1 6/2017 Tessmer et al.
2017/0281438 A1 10/2017 Elku et al.
2018/0000673 A1 1/2018 Bartley
2018/0116885 A1 5/2018 St. John et al.
2019/0083338 A1* 3/2019 Childs ..... A61G 7/16
2020/0038272 A1* 2/2020 Latney ..... A61G 7/165

FOREIGN PATENT DOCUMENTS

CA 2018815 C 11/1999
CA 2293085 A1 6/2001
CA 2696686 C 1/2015
CN 101077325 A 11/2007
CN 201905562 U 7/2011
CN 202843982 U 4/2013
CN 101868215 B 8/2013
CN 204192905 U 3/2015
CN 204379588 U 6/2015
CN 204814540 U 12/2015
DE 2749146 A1 5/1978
DE 4039253 A1 6/1992
DE 19634419 A1 3/1998
DE 202004003299 U1 5/2004
EP 0375206 B1 3/1994
EP 0746298 B1 3/2003
EP 0932385 B1 3/2004
EP 0957877 B1 4/2005
EP 1545345 A1 6/2005
EP 1789278 A2 5/2007
EP 1416897 B1 5/2008
EP 1487392 B1 5/2008
EP 1459722 B1 6/2010
EP 1976433 B1 3/2011
EP 2484326 A2 8/2012
EP 2484326 A3 12/2012
EP 1693037 B1 1/2013
EP 1948109 A4 4/2013
EP 2174670 B1 4/2013
EP 2174631 B1 6/2013
EP 2462911 A3 9/2013
EP 2275071 B1 11/2013
EP 2151222 B1 3/2014
EP 2716269 A1 4/2014
EP 2462912 B1 11/2014

(56) References Cited

FOREIGN PATENT DOCUMENTS

| | | | |
|---|---|---|---|
| EP | 2863858 | A4 | 10/2015 |
| EP | 1916926 | B1 | 11/2015 |
| EP | 2481388 | B1 | 11/2015 |
| EP | 2327385 | B1 | 3/2016 |
| EP | 2854602 | B1 | 9/2016 |
| GB | 905708 | A | 9/1962 |
| GB | 1212107 | A | 11/1970 |
| GB | 2185883 | A | 8/1987 |
| JP | H03151913 | A | 6/1991 |
| JP | H04341264 | A | 11/1992 |
| JP | H0731644 | A | 2/1995 |
| JP | H11104190 | A | 4/1999 |
| JP | 2002095703 | A | 4/2002 |
| JP | 2005066250 | A | 3/2005 |
| JP | 4854665 | B2 | 1/2012 |
| JP | 2013240601 | A | 12/2013 |
| JP | 2014188340 | A | 10/2014 |
| JP | 2015107283 | A | 6/2015 |
| KR | 20130076922 | A | 7/2013 |
| KR | 20130111088 | A | 10/2013 |
| TW | 201316976 | A | 5/2013 |
| WO | 9219203 | A1 | 11/1992 |
| WO | 9520933 | A1 | 8/1995 |
| WO | 1998007402 | A1 | 2/1998 |
| WO | 2004014193 | A1 | 2/2004 |
| WO | 2006023447 | A2 | 3/2006 |
| WO | 2006056146 | A1 | 6/2006 |
| WO | 2006138252 | A2 | 12/2006 |
| WO | 2007055051 | A1 | 5/2007 |
| WO | 2007145544 | A1 | 12/2007 |
| WO | 2008130741 | A2 | 10/2008 |
| WO | 2009029996 | A1 | 3/2009 |
| WO | 2011113070 | A1 | 9/2011 |
| WO | 2013192411 | A2 | 12/2013 |
| WO | 2014029988 | A1 | 2/2014 |
| WO | 2015126742 | A1 | 8/2015 |
| WO | 2016171746 | A | 10/2016 |

OTHER PUBLICATIONS

InkBed, "Brand New Model InkBed Patened Fully Adjustable Tattoo Table & Bed Webpage", http://www.inkbed.com/brand-new-model-inkbed-patented-fully-adjustable-tattoo-table-bed/, 2019, 3 pages.
Astral Healthcare, "DOC Classic Opthalmology Day Surgery Chair Webpage and Video", 2017, 6 pages.
English language abstract and machine-assisted English translation for JPH 04-341264 extracted from espacenet.com database on Jan. 2, 2019, 9 pages.
English language abstract and machine-assisted English translation for CN 101077325 extracted from espacenet.com database on Oct. 24, 2018, 7 pages.
English language abstract and machine-assisted English translation for CN 201905562 extracted from espacenet.com database on Oct. 24, 2018, 8 pages.
English language abstract and machine-assisted English translation for CN 202843982 extracted from espacenet.com database on Oct. 24, 2018, 7 pages.
English language abstract and machine-assisted English translation for CN 204192905 extracted from espacenet.com database on Oct. 24, 2018, 8 pages.
English language abstract and machine-assisted English translation for CN 204814540 extracted from espacenet.com database on Jan. 2, 2019, 10 pages.
English language abstract and machine-assisted English translation for CN204379588 extracted from espacenet.com database on Oct. 24, 2018, 8 pages.
English language abstract and machine-assisted English translation for DE 196 34 419 extracted from espacenet.com database on Oct. 24, 2018, 6 pages.
English language abstract and machine-assisted English translation for DE 20 2004 003 299 extracted from espacenet.com database on Jan. 2, 2019, 8 pages.
English language abstract and machine-assisted English translation for DE 27 49 146 extracted from espacenet.com database on Oct. 24, 2018, 17 pages.
English language abstract and machine-assisted English translation for DE 40 39 253 extracted from espacenet.com database on Oct. 24, 2018, 7 pages.
English language abstract and machine-assisted English translation for JP 2002-095703 extracted from espacenet.com database on Oct. 24, 2018, 12 pages.
English language abstract and machine-assisted English translation for JP 2005-066250 extracted from espacenet.com database on Jan. 2, 2019, 9 pages.
English language abstract and machine-assisted English translation for JP 2014-188340 extracted from espacenet.com database on Oct. 24, 2018, 10 pages.
English language abstract and machine-assisted English translation for JP 2015-107283 extracted from espacenet.com database on Oct. 24, 2018, 19 pages.
English language abstract and machine-assisted English translation for JPH 03-151913 extracted from espacenet.com database on Jan. 2, 2019, 5 pages.
English language abstract and machine-assisted English translation for JPH 07-31644 extracted from espacenet.com database on Oct. 24, 2018, 6 pages.
English language abstract and machine-assisted English translation for JPH 11-104190 extracted from espacenet.com database on Jan. 2, 2019, 15 pages.
English language abstract and machine-assisted English translation for KR 2013-0076922 extracted from espacenet.com database on Oct. 24, 2018, 8 pages.
English language abstract and machine-assisted English translation for KR 2013-0111088 extracted from espacenet.com database on Oct. 24, 2018, 11 pages.
English language abstract and machine-assisted English translation for TW 201316976 extracted from espacenet.com database on Jan. 2, 2019, 12 pages.
English language abstract for CN 101868215 extracted from espacenet.com database on Oct. 24, 2018, 2 pages.
English language abstract for JP 2013-240601 extracted from espacenet.com database on Oct. 24, 2018, 2 pages.
English language abstract for WO 2007/055051 and machine-assisted English translation for corresponding JP 2007-130055 extracted from espacenet.com database on Jan. 2, 2019, 17 pages.
Ford Motor Company, "Memory Seat Escape Video", https://www.youtube.com/watch?v=xlghNmAK-7A, 2013, 2 pages.
Hill-Rom, "Centrella Smart+Bed Brochure" 2017, 11 pages.
Hill-Rom, "Centrella Smart+Bed Therapeutic Surfaces Brochure", Sep. 20, 2017, 3 pages.
Hill-Rom, "The Hill-Rom 900 Accella Bed Brochure", May 12, 2017, 16 pages.
Machine-assisted English translation for JP 4854665 extracted from espacenetcom database on Jan. 2, 2019, 31 pages.
Supportec Trade, "Surgery Chairs-Classic and Maxi Webpages", https://supportec-trade.nl/ formerly http://www.dogemedical.com/pages/en/products/surgery-chairs/doc-classic.php, 2017, 10 pages.
Ultracomfort America Furniture Manufacturing, "UltraComfort Stellar UC550 Large Lift Chair Webpage and Video", https://www.recliners.la/products/ultra-comfort-stellar-550-large-lift-chair, 2018, 3 pages.
U.S. Appl. No. 16/020,085, filed Jun. 27, 2018.
U.S. Appl. No. 16/134,004, filed Sep. 18, 2018.
U.S. Appl. No. 16/134,048, filed Sep. 18, 2018.
U.S. Appl. No. 16/134,438, filed Sep. 18, 2018.

* cited by examiner

PATIENT SUPPORT APPARATUS WITH HANDLES FOR PATIENT AMBULATION

CROSS-REFERENCE TO RELATED APPLICATION

The subject patent application claims priority to and all the benefits of U.S. Provisional Patent Application No. 62/560,335 filed on Sep. 19, 2017, the disclosure of which is hereby incorporated by reference in its entirety.

TECHNICAL FIELD

The present disclosure relates, generally, to patient support apparatuses and, more specifically, to a patient support apparatus with handles for patient ambulation.

BACKGROUND

Patient support apparatuses, such as hospital beds, stretchers, cots, tables, wheelchairs, and chairs are used to help caregivers facilitate care of patients in a health care setting. Conventional patient support apparatuses comprise a base, a support frame, a patient support deck operatively attached to the support frame, a lift assembly for lifting and lowering the support frame relative to the base, and actuators arranged to move sections of the patient support deck relative to the support frame.

Certain conventional patient support apparatuses, such as those realized as hospital beds, are primarily employed to provide support to a patient lying on the patient support deck. To this end, one or more sections of the patient support deck provide support to the patient's head, torso, legs, and feet, allowing the patient to lay on their side, on their back in a supine position, and the like. In addition, one or more sections of the patient support deck can typically be moved or oriented relative to one another to promote patient comfort and to help facilitate patient mobility. By way of example, the patient support deck may be movable into a fowler position to allow the patient to lay upright.

In order to allow the patient to exit the hospital bed, the lift assembly is used to lower the patient support deck towards the base so as to position the patient vertically near the floor. Next, the patient re-orients their body to bring their legs and feet into contact with the floor at one side of the patient support apparatus. To this end, the patient typically sits upright and turns sideways while moving their legs and feet away from the patient support deck to bring their feet into contact with the floor to stand. Other types of patient support apparatuses are configured to allow the patient to be moved to a seated position to exit at a foot end of the patient support apparatus as opposed to a side.

It will be appreciated that the process of successfully exiting a patient support apparatus without assistance is often an important component of physical and/or occupational therapy. The patient may not be cleared to leave a hospital after a surgical procedure until they are able to exit the hospital bed unassisted. However, the process of exiting the hospital bed can be difficult for patients under certain circumstances. By way of example, if the patient is recovering from a complex medical procedure and/or a serious injury, he or she may be unable to re-orient his or her body, turn, and/or stand without the help of a medical professional. Similarly, if the patient is obese, he or she may require the help of multiple medical professionals to exit the bed. Under such circumstances, it is possible for patients to fall and injure themselves.

While conventional patient support apparatuses have generally performed well for their intended purpose, there remains a need in the art for a patient support apparatus which overcomes the disadvantages in the prior art while, at the same time, contributing to improved patient mobility, safety, and ambulation.

DETAILED DESCRIPTION OF THE EMBODIMENTS

Figure 1:
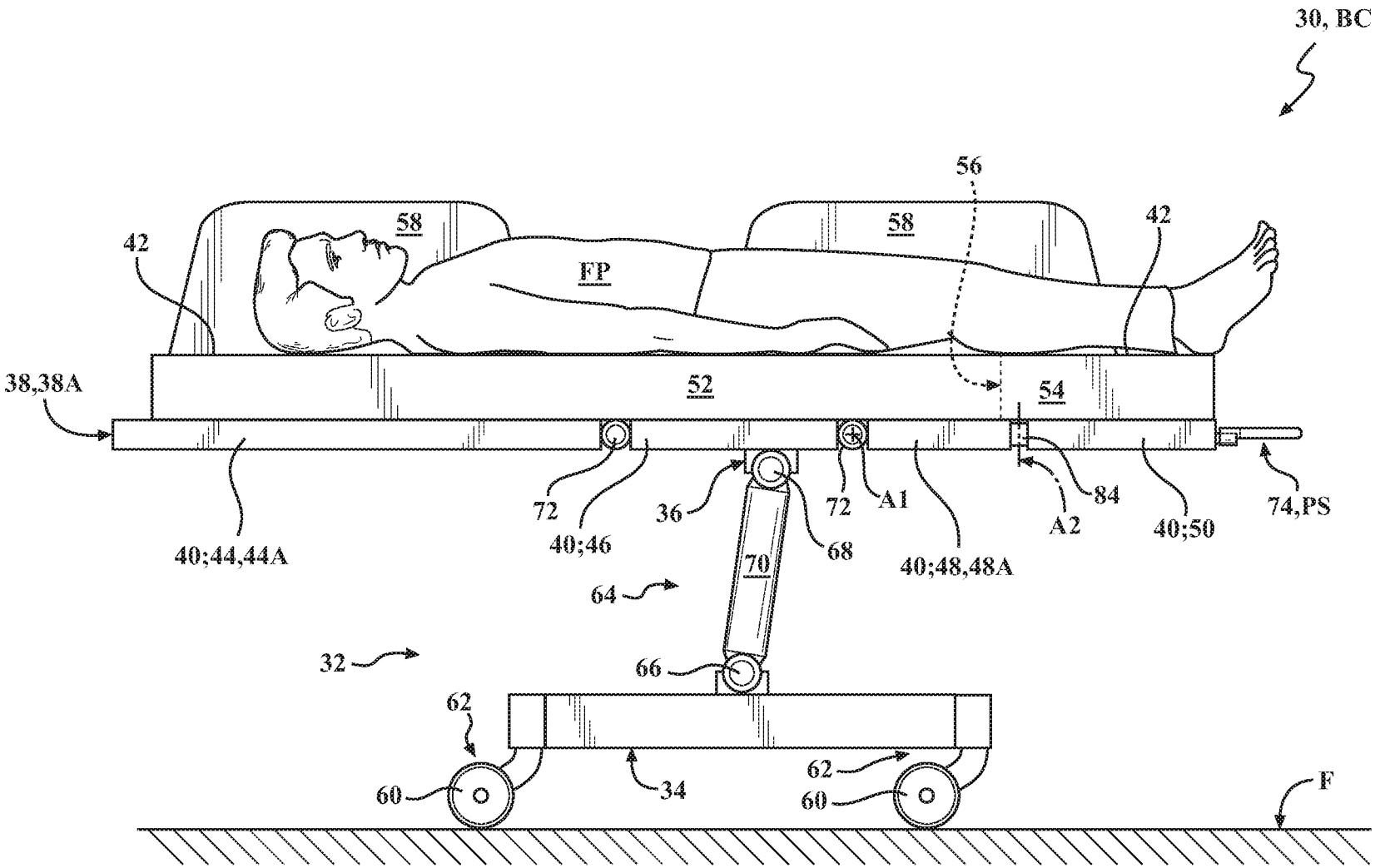
FIG. 1 is a right-side view of a patient support apparatus shown having a base and a patient support deck in a bed configuration, the patient support deck having a back section, a seat section, a leg section, and a pair of foot sections each supporting a patient in a flat position.

Referring to FIGS. 1-6, a patient support apparatus 30 is shown for supporting a patient in a health care setting. The patient support apparatus 30 illustrated throughout the drawings is realized as a hospital bed. In other embodiments, however, the patient support apparatus 30 may be a stretcher, a cot, a table, or a similar apparatus utilized in the care of a patient.

A support structure 32 provides support for the patient. In the representative embodiment illustrated herein, the support structure 32 comprises a base 34, an intermediate frame 36, and a patient support deck 38. The intermediate frame 36 and the patient support deck 38 are spaced above the base 34 and, as is described in greater detail below, are arranged for movement relative to the base 34 between a plurality of vertical configurations 38A, 38B.

The patient support deck 38 has at least one deck section 40 arranged for movement relative to the intermediate frame 36 between a plurality of section positions, as described in greater detail below. The deck sections 40 of the patient support deck 38 provide a patient support surface 42 upon which the patient is supported. More specifically, in the representative embodiment of the patient support apparatus 30 illustrated herein, the patient support deck 38 has discrete deck sections 40 which cooperate to define the patient support surface 42: a back section 44, a seat section 46, a leg section 48, and a pair of foot sections 50. Here, the seat section 46 is fixed to the intermediate frame 36 and is not arranged for movement relative thereto. However, it will be appreciated that the seat section 46 could be movable relative to other deck sections 40 in some embodiments. Conversely, the back section 44 and the leg section 48 are arranged for independent movement relative to each other and to the intermediate frame 36, as described in greater detail below, and the foot sections 50 are arranged to articulate relative to the leg section 48 and also to move partially concurrently with the leg section 48. Other configurations and arrangements are contemplated. It will be appreciated that the terms "back," "seat," "leg," and "foot" are used herein to differentiate the deck sections 40 from each other and are not intended to be limiting unless specifically indicated.

A mattress 52 is disposed on the patient support deck 38 during use. The mattress 52 comprises a secondary patient support surface upon which the patient is supported. The base 34, the intermediate frame 36, and the patient support deck 38 each have a head end and a foot end corresponding to designated placement of the patient's head and feet on the patient support apparatus 30. It will be appreciated that the specific configuration of the support structure 32 may take on any known or conventional design, and is not limited to that specifically illustrated and described herein. In addition, the mattress 52 may be omitted in certain embodiments, such that the patient can rest directly on the patient support surface 42 defined by the deck sections 40 of the patient support deck 38. As is described in greater detail below, the mattress 52 has foot bolsters 54 arranged at each of the foot sections 50. As is depicted in FIGS. 1-6, the foot bolsters 54 move concurrently with the respective foot sections 50 to articulate relative to the leg section 48. To this end, the mattress 52 is provided with seams 56 which couple the foot bolsters 54 to the mattress 52 and facilitate movement therebetween. It will be appreciated that the mattress 52, the foot bolsters 54, and/or seams 56 can be arranged or configured in a number of different ways sufficient to provide support to the patient. By way of non-limiting example, the mattress 52 could be realized by discrete mattress sections coupled to each of the respective deck sections 40, with one or more of the mattress sections being configured to be releasably attached to the patient support deck 38. Thus, while the foot bolsters 54 are coupled to the mattress 52 via the seams 56 in the representative embodiment illustrated in FIGS. 1-6, the foot bolsters 54 could be formed separately from the mattress 52 and could be removable from the foot sections 50. Other configurations are contemplated.

Side rails 58 are coupled to the support structure 32 to limit patient movement off of the patient support surface 42. The patient support apparatus 30 generally comprises four discrete side rails 58: one at each of a right head end, a right foot end, a left head end, and a left foot end of the patient support deck 38. In FIGS. 1-6, which depict right-side views of the patient support apparatus 30, only two side rails 58 (one at the left head end and one at the left foot end) are illustrated for clarity. The side rails 58 are advantageously movable between a raised position in which they block ingress and egress into and out of the patient support apparatus 30, one or more intermediate positions, and a lowered position in which they are not an obstacle to such ingress and egress. It will be appreciated that there may be fewer side rails 58 for certain embodiments, such as where the patient support apparatus 30 is realized as a stretcher or a cot. Moreover, it will be appreciated that in certain configurations, the patient support apparatus 30 may not include any side rails 58. Similarly, it will be appreciated that side rails 58 may be attached to any suitable component or structure of the patient support apparatus 30. By way of non-limiting example, side rails 58 may be coupled to the intermediate frame 36 or to one or more of the deck sections 40 for concurrent movement.

Depending on the specific configuration of the patient support apparatus 30, a headboard and/or a footboard (not shown) may be coupled to the intermediate frame 36 and/or to one of the deck sections 40 to further limit patient ingress and egress. While the patient support apparatus 30 illustrated throughout the drawings does not employ a headboard or a footboard, the Applicant has described patient support apparatuses 30 which do employ headboards, footboards, and side rails 58 in U.S. Pat. No. 7,690,059 B2, the disclosure of which is hereby incorporated by reference in its entirety. Other configurations are contemplated.

Wheels 60 are coupled to the base 34 to facilitate transportation over a floor surface F. The wheels 60 are arranged in each of four quadrants of the base 34, adjacent to corners of the base 34. In the embodiment shown in FIGS. 1-6, the wheels 60 are caster wheels able to rotate and swivel relative to the support structure 32 during transport. Here, each of the wheels 60 forms part of a caster assembly 62 mounted to the base 34. It should be understood that various configurations of the caster assemblies 62 are contemplated. In addition, in some embodiments, the wheels 60 are not caster wheels.

Moreover, it will be appreciated that the wheels 60 may be non-steerable, steerable, non-powered, powered, or combinations thereof. While the representative embodiment of the patient support apparatus 30 illustrated herein employs four wheels 60, additional wheels are also contemplated. For example, the patient support apparatus 30 may comprise four non-powered, non-steerable wheels, along with one or more additional powered wheels. In some cases, the patient support apparatus 30 may not include any wheels. In other embodiments, one or more auxiliary wheels (powered or non-powered), which are movable between stowed positions and deployed positions, may be coupled to the support structure 32. In some cases, when auxiliary wheels are located between caster assemblies 62 and contact the floor surface in the deployed position, they cause two of the caster assemblies 62 to be lifted off the floor surface F, thereby shortening a wheel base of the patient support apparatus 30. A fifth wheel may also be arranged substantially in a center of the base 34.

Figure 2:
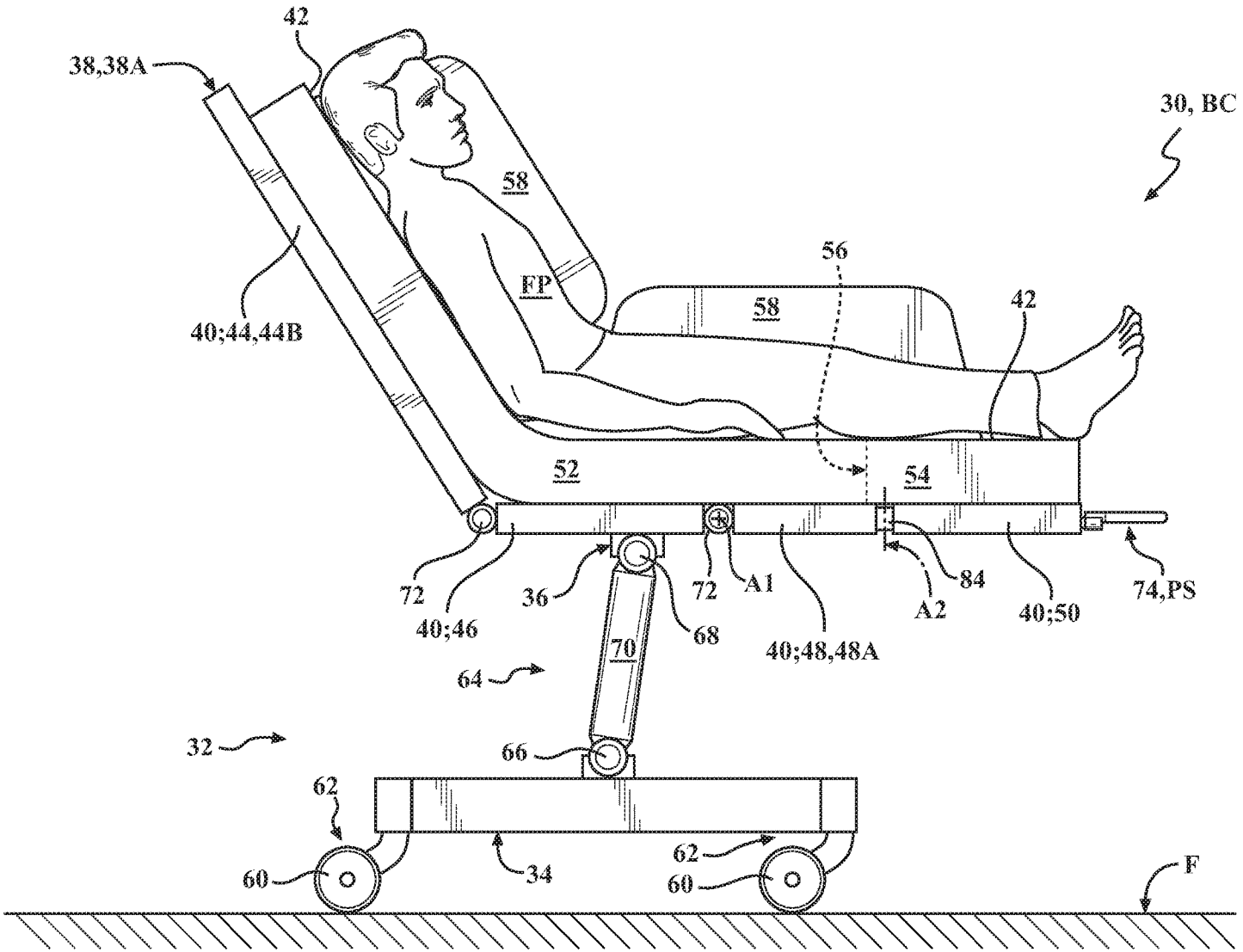
FIG. 2 is another right-side view of the patient support apparatus of FIG. 1, shown with the back section articulated to support the patient in a fowler position, the patient support apparatus shown with a lift mechanism supporting the patient support deck in a first vertical configuration relative to a floor surface supporting the base.
Figure 3:
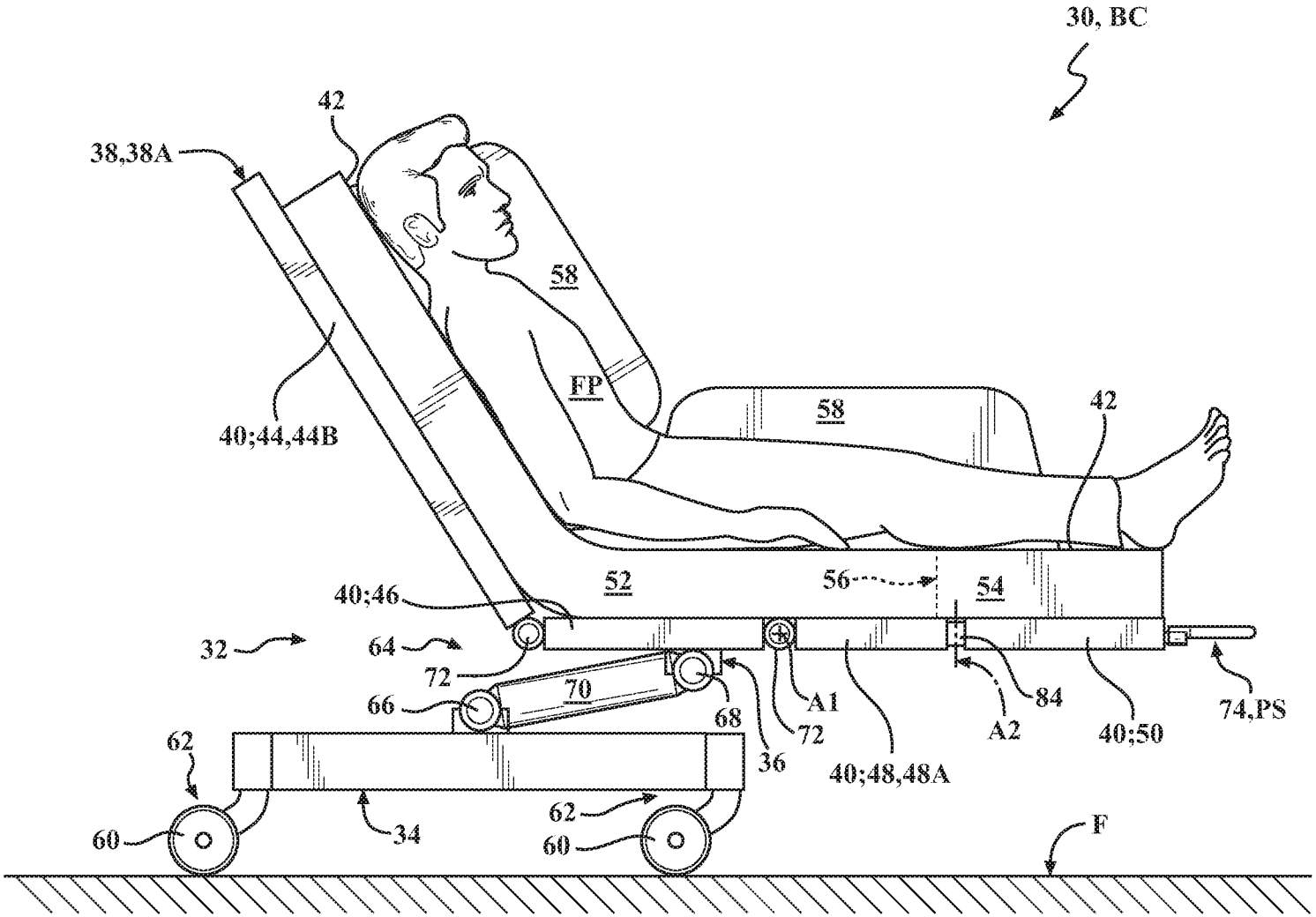
FIG. 3 is another right-side view of the patient support apparatus of FIG. 2, shown with the lift mechanism supporting the patient support deck in a second vertical configuration relative to the floor surface.
Figure 4:
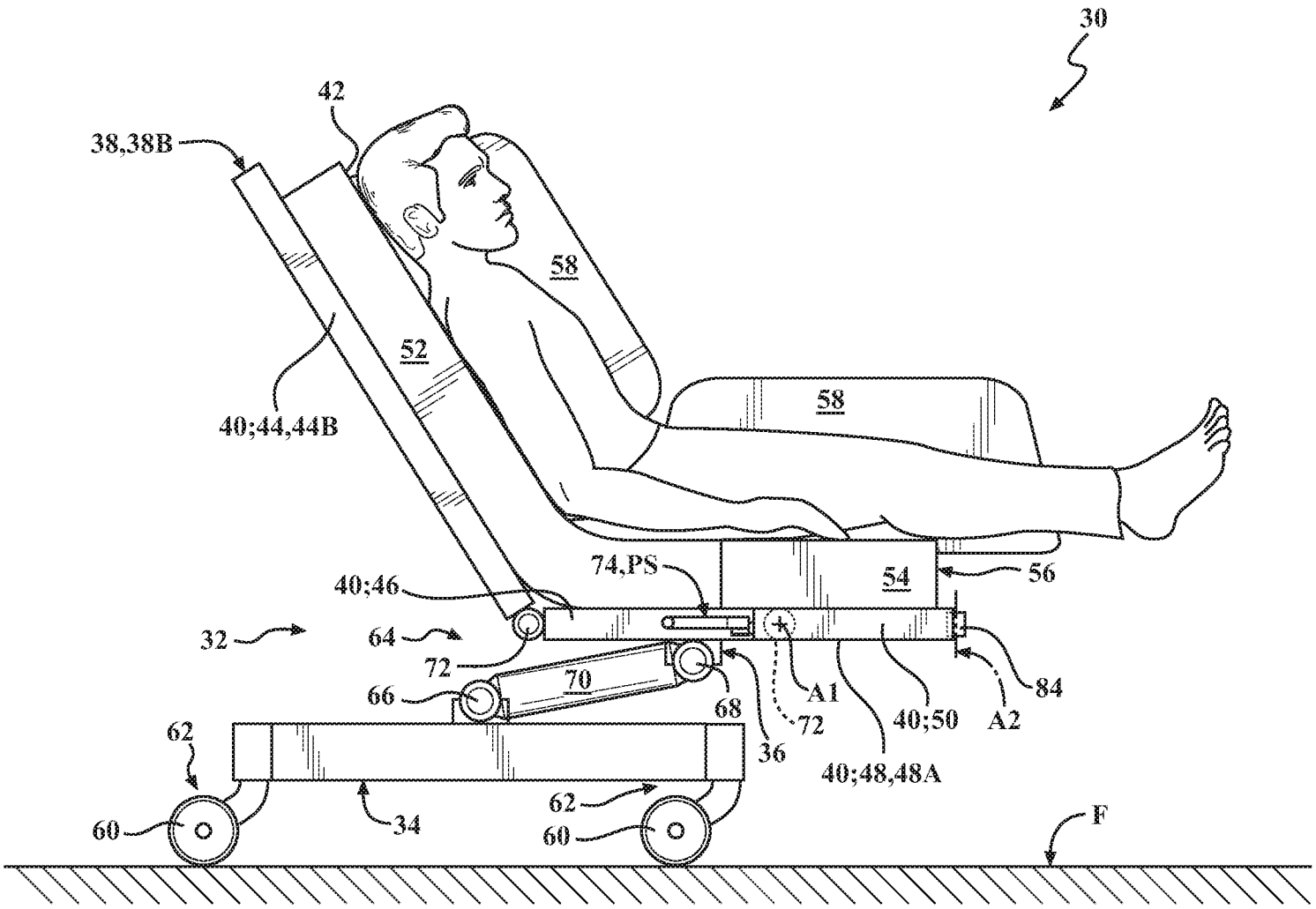
FIG. 4 is another right-side view of the patient support apparatus of FIG. 3, shown with the foot sections articulated relative to the leg section and out of support of the patient.

The patient support apparatus 30 further comprises a lift mechanism, generally indicated at 64, which operates to lift and lower the intermediate frame 36 relative to the base 34 which, in turn, moves the patient support deck 38 between a first vertical configuration 38A (for example, a "raised" vertical position as depicted in FIGS. 1-2), a second vertical configuration 38B (for example, a "lowered" vertical position as depicted in FIGS. 3-6), or to any desired vertical position in between. To this end, the lift mechanism 64 comprises a base lift actuator 66, a frame lift actuator 68, and a lift member 70 extending between the base lift actuator 66 and the frame lift actuator 68. In the representative embodiment illustrated herein, the base lift actuator 66 and the frame lift actuator 68 are each realized as electrically-powered rotary actuators which cooperate to effect movement of the patient support deck 38 relative to the base 34 between the vertical configurations 38A, 38B, as noted above. Those having ordinary skill in the art will appreciate that the base lift actuator 66 and the frame lift actuator 68 can also be configured to "tilt" the patient support deck 38 relative to the base 34, such as to place the patient in a Trendelenburg position (not shown). The Applicant has described different types of rotary actuators and patient support apparatuses 30 which employ rotary actuators in United States Patent Application Publication No. US 2018/0000673 A1, the disclosure of which is hereby incorporated by reference in its entirety. Other types of actuators are contemplated.

While the lift mechanism 64 employs rotary actuators to facilitate movement of the patient support deck 38 relative to the base 34, it will be appreciated that different types of lift mechanisms 64 could be utilized in certain embodiments. By way of non-limiting example, the lift mechanism 64 could comprise one or more linear actuators, linkages, and the like which cooperate to move the patient support deck 38 relative to the base 34. Thus, the lift mechanism 64 may take on any known or conventional design, is not limited to that specifically illustrated, and may employ linear actuators, rotary actuators, and/or other types of actuators, each of which may be electrically operated, hydraulic, pneumatic, or combinations thereof. The applicant has described one type of lift mechanism which employs linear actuators in United States Patent Application Publication No. US 2016/0302985 A1, the disclosure of which is hereby incorporated by reference in its entirety. Other configurations and arrangements of the lift mechanism 64 are contemplated.

In the representative embodiment illustrated in FIGS. 1-6, the intermediate frame 36 is realized as a portion of the seat section 46 of the patient support deck 38 which is adapted to couple to the lift mechanism 64. Here, the seat section 46 supports both the back section 44 and the leg section 48, and the leg section 48 supports each of the foot sections 50 as described in greater detail below. However, those having ordinary skill in the art will appreciate that the patient support apparatus 30 could employ different types of intermediate frames 36 in certain embodiments. By way of non-limiting example, the intermediate frame 36 could be configured such that each of the deck sections 40 is at least partially supported by the intermediate frame 36 as opposed to being supported by an adjacent deck section 40.

As noted above, the patient support deck 38 is operatively attached to the intermediate frame 36 via the seat section 46 which, in turn, supports the back section 44 and the leg section 48 which, in turn, supports the foot sections 50. In the representative embodiment illustrated herein, the patient support deck 38 is provided with deck actuators, generally indicated at 72, interposed between the seat section 48 and the back section 44 and also between the seat section 46 and the leg section 48. Like the lift actuators 66, 68 described above, the deck actuators 72 are implemented as rotary actuators and move the respective deck sections 40 relative to the seat section 46 between different section positions. By way of non-limiting example, the deck actuators 72 interposed between the seat section 46 and the back section 44 of the patient support deck 38 are arranged to move the back section 44 relative to the seat section 46 between a "flat" first back section position 44A (see FIG. 1), a "raised" second back section position 44B (see FIG. 2), such as to place the patient support deck 38 in a fowler position, and also any other suitable back section position. Similarly, the deck actuators 72 interposed between the seat section 46 and the leg section 48 of the patient support deck 38 are arranged to move the leg section 48 and the foot sections 50 relative to the seat section 46 between a "flat" first leg section position 48A (see FIGS. 1-4), a "lowered" second leg section position 48B arranged adjacent to the floor surface F (see FIGS. 5-6), and also any other suitable leg section position. Thus, the deck actuators 72 cooperate to position the respective deck sections 40 so as to adjust the shape of the patient support surface 42 between a plurality of patient support configurations (for example, a flat configuration, a raised fowler configuration, a seated configuration, etc.).

Like the lift actuators 66, 68 described above, the deck actuators 72 are implemented as rotary actuators in the illustrated embodiment. Here too, it will be appreciated that the deck actuators 72 could be configured in a number of different ways sufficient to move the deck sections 40. Those having ordinary skill in the art will appreciate that the patient support apparatus 30 could employ any suitable number of deck actuators 72, of any suitable type or configuration sufficient to effect selective movement of the deck section 40. By way of non-limiting example, the deck actuators 72 could be linear actuators or one or more rotary actuators driven electronically, pneumatically, and/or hydraulically, controlled or driven in any suitable way. Moreover, the deck actuators 72 could be mounted, secured, coupled, or otherwise operatively attached to the intermediate frame 36 and to the respective deck section 40, either directly or indirectly, in any suitable way. In addition, one or more of the deck actuators 72 could be omitted for certain applications. By way of non-limiting example, the back section 44 could be configured for manually-actuated adjustment relative to the seat section 46, such as with a linkage or another mechanism (not shown). Other configurations are contemplated.

Referring now to FIGS. 1-12, as noted above, the patient support apparatus 30 is configured to support the patient and also to help ambulate the patient to the floor surface F. To this end, the illustrated embodiment of the patient support deck 38 of the patient support apparatus 30 is operable between a bed configuration BC (see FIGS. 1-3 and 7-8) and a chair configuration CC (see FIGS. 5-6 and 10-12). When the patient support deck 38 is utilized in the bed configuration BC, the seat section 46, the leg section 48, and each of the foot sections 50 cooperate to support the patient in a flat position FP, such as with the patient laying on their back (see FIG. 1) or with the patient laying upright in a fowler position (see FIG. 2). Here, it will be appreciated that the flat position FP could be defined by any arrangement of the patient support deck 38 where the seat section 46, the leg section 48, and each of the foot sections 50 are arranged to define a respective part of the patient support surface 42, irrespective of the position and/or orientation of the patient's body. Conversely, when the patient support deck 38 is utilized in the chair configuration CC, the seat section 46 supports the patient in a seated position SP while the leg section 48 is articulated adjacent to the floor surface F (see FIG. 5), and the foot sections 50 are each articulated relative to the leg section 48 out of support of the patient (compare FIGS. 3-5). Here, it will be appreciated that the seated position SP could be defined by any arrangement of the patient support deck 38 where the foot sections 50 no longer define part of the patient support surface 42 and where the section 48 is articulated in such a way to allow the patient to "sit" on the seat section 46. In some embodiments, the seated position SP is further defined by the back section 44 being articulated relative to the seat section 46 so as to provide support to the patient's back.

Figure 5:
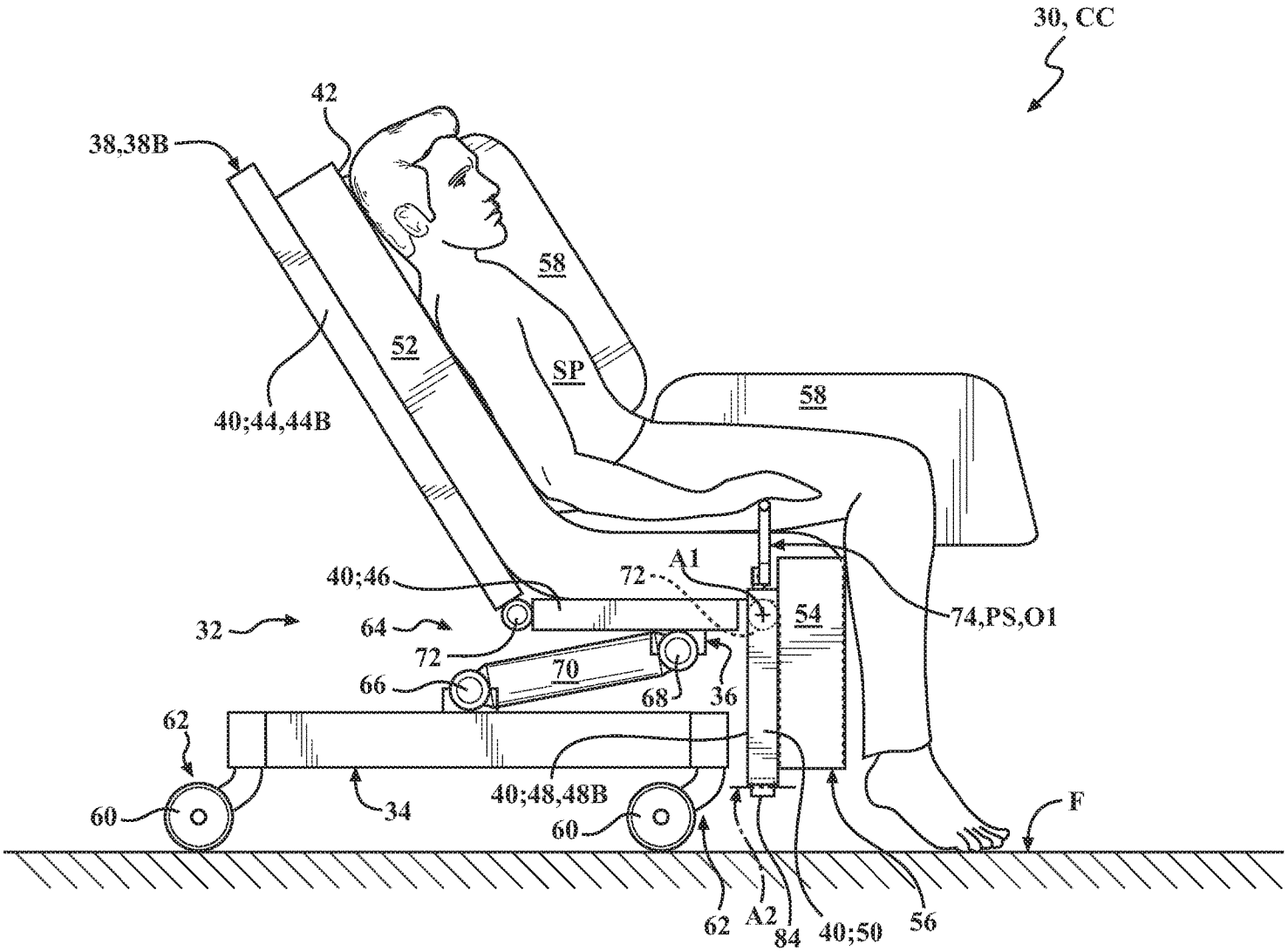
FIG. 5 is another right-side view of the patient support apparatus of FIG. 4, depicting the patient support deck supporting the patient in a seated position and arranged in a chair configuration with the leg section and the foot sections articulated adjacent to the floor surface and out of support of the patient, the patient support apparatus shown having handles coupled to the foot sections to facilitate patient ambulation with the handles arranged in a stowed position.
Figure 6:
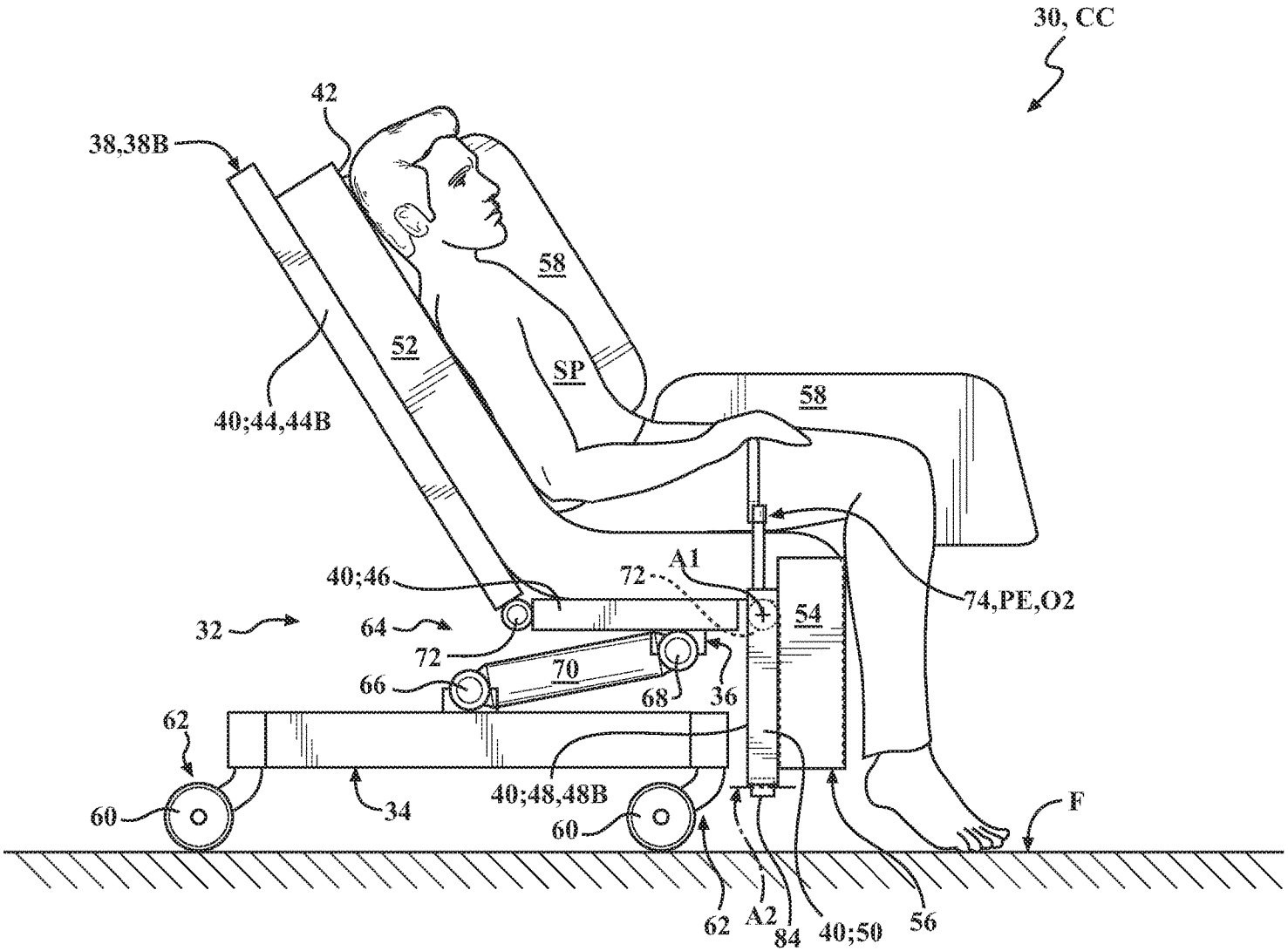
FIG. 6 is another right-side view of the patient support apparatus of FIG. 5, shown with the handles arranged in an extended position to facilitate patient ambulation to the floor surface from the seated position with the patient support deck in the chair configuration.

In order to facilitate patient ambulation to the floor surface F, and with reference to FIGS. 7-12, the patient support apparatus 30 comprises a pair of handles, generally indicated at 74. The handles 74 are each coupled to one of the foot sections 50 of the patient support deck 38 and are arranged to facilitate patient ambulation when the patient support deck 38 is in the chair configuration CC. While a pair of handles 74 are depicted in the illustrated embodiment, it will be appreciated that a single handle 74 could be utilized. As shown in FIGS. 5-6, operation of the patient support deck 38 in the chair configuration CC positions the handles 74 adjacent to the hands of the patient in the seated position SP. Thus, from the chair configuration CC, the patient can grasp the handles 74 to help transition from the seated position SP supported by the seat section 46 to a standing position for ambulating along the floor surface F.

Figure 11:
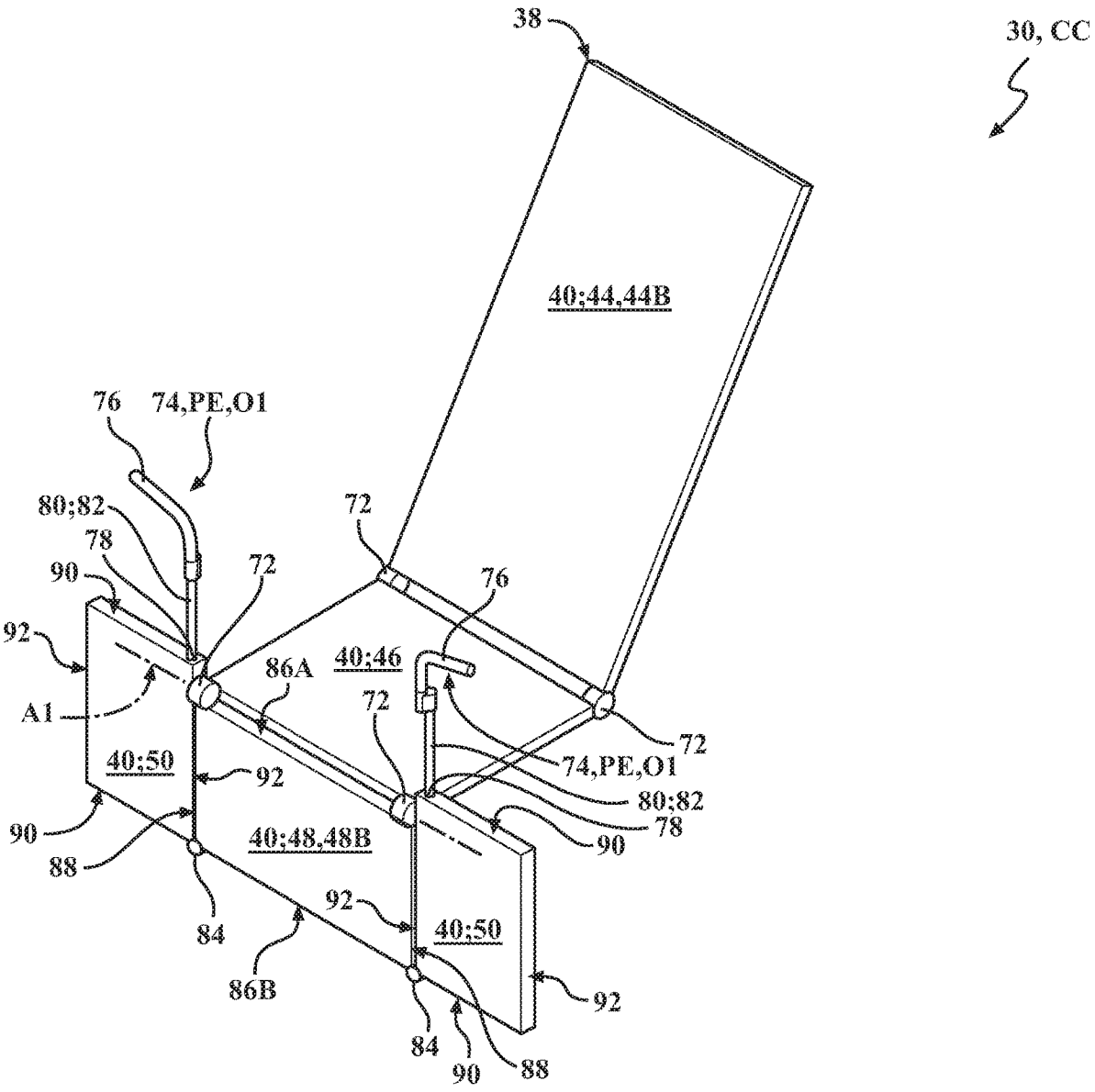
FIG. 11 is another perspective view of the patient support deck of FIGS. 7-10, shown with the handles in the extended position.
Figure 12:
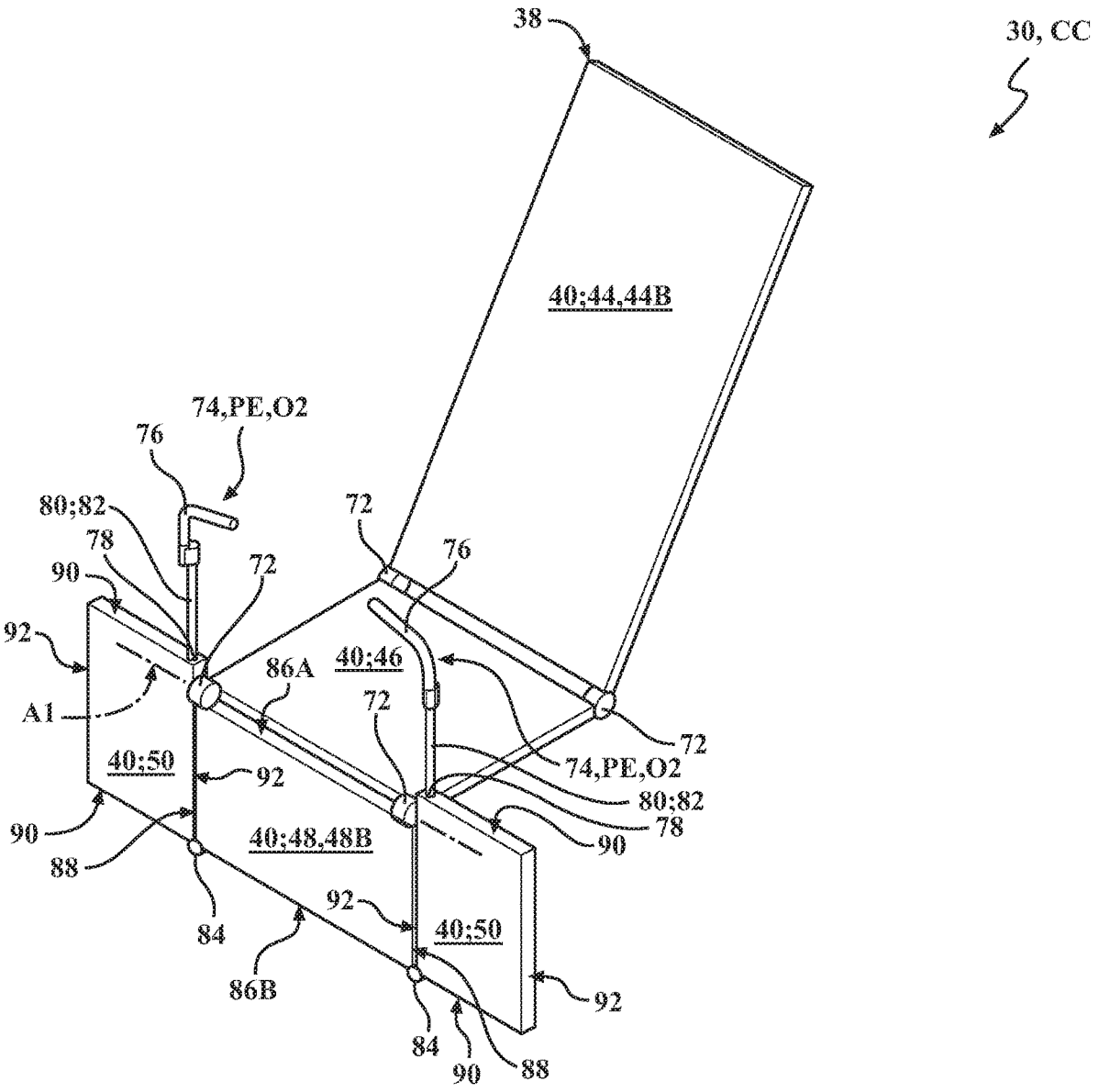
FIG. 12 is another perspective view of the patient support deck of FIG. 11, shown with the handles in the extended position and rotated to facilitate patient ambulation to the floor surface as depicted in FIG. 6.

In the representative embodiment illustrated herein, each of the handles 74 comprises a hand grip portion 76, a mount portion 78, and a body portion 80 extending between the hand grip portion 76 and the mount portion 78 (see FIGS. 11-12). The hand grip portions 76 are each shaped and arranged to be grasped by the patient, as noted above. In the illustrated embodiment, the mount portions 78 are coupled to or otherwise formed as a part of the respective foot sections 50 such that the handles 74 move concurrently with the foot sections 50. However, it will be appreciated that one or more handles 74 could be coupled to parts of the patient support apparatus 30 other than the foot sections 50 without departing from the scope of the present disclosure. Furthermore, it will be appreciated that the specific shape and arrangement of the handles 74 could be adjusted to suit different applications.

As is best depicted in FIGS. 11-12, the body portion 80 of each of the handles 74 comprises a telescoping mechanism, generally indicated at 82, which is configured to move the hand grip portion 76 relative to the mount portion 78 between a stowed position PS (see FIGS. 7-10) and an extended position PE (see FIGS. 11-12). In the representative embodiment illustrated herein, the body portion 80 of the handles 74 has an elongated, generally cylindrical configuration and is slidably supported by the mount portion 78, which is formed as a cylindrical bore formed in the foot section 50. In addition to being configured for movement between the stowed position PS and the extended position PE, in some embodiments the handles 74 are also configured to be rotatable between a first orientation O1 facing away from the patient support deck 38 (see FIGS. 10-11), a second orientation O2 facing toward the patient support deck 38 (see FIG. 12). Other orientations are contemplated. In the illustrated second orientation O2, the handles 74 are positioned for use by the patient to facilitate ambulation, as noted above. It will be appreciated that movement of the handles 74 between the stowed position PS and the extended position PE can be independent of or concurrent with rotation from the first orientation O1 and the second orientation O2. Furthermore, those having ordinary skill in the art will appreciate that the first orientation O1 and/or the second orientation O2 could be defined in a number of different ways, and that the handles 74 can be independently moved. By way of non-limiting illustration, one handle 74 could be in the first orientation O1 and another handle 74 could be in the second orientation O2 in some embodiments. It will be appreciated that the handles 74 can be configured for powered or manually-actuated movement, and can be configured to "lock" or "detent" in certain positions and/or orientations. In some embodiments, the handles 74 are not arranged for movement relative to the foot sections 50. Those having ordinary skill in the art will appreciate that the handles 74 could be of any suitable shape, configuration, or arrangement sufficient to promote patient ambulation from the seated position SP when the patient support deck 38 is in the chair configuration CC, as noted above. Moreover, while the handles 74 move concurrently with the respective foot sections 50 in the illustrated embodiment, handles 74 could be coupled to other portions of the patient support apparatus 30 to promote patient ambulation from the seated position SP, as noted above. Other configurations are contemplated.

With continued reference to the embodiment illustrated in FIGS. 7-12, as noted above, the articulation of the leg section 48 relative to the seat section 46 and the articulation of the foot sections 50 relative to the leg section 48 allows the foot sections 50 to be moved out of support of the patient in the chair configuration CC. In the illustrated embodiment, the foot sections 50 are each arranged substantially parallel to the leg section 48 and remain parallel to the leg section 50 during articulation relative thereto. To this end, in one embodiment, the patient support apparatus 30 further comprises a pair of foot hinge mechanisms, generally indicated at 84, which are each coupled to the leg section 48 and to one of the foot sections 50 to facilitate articulation of the foot sections 50 relative to the leg section 48.

Figure 7:
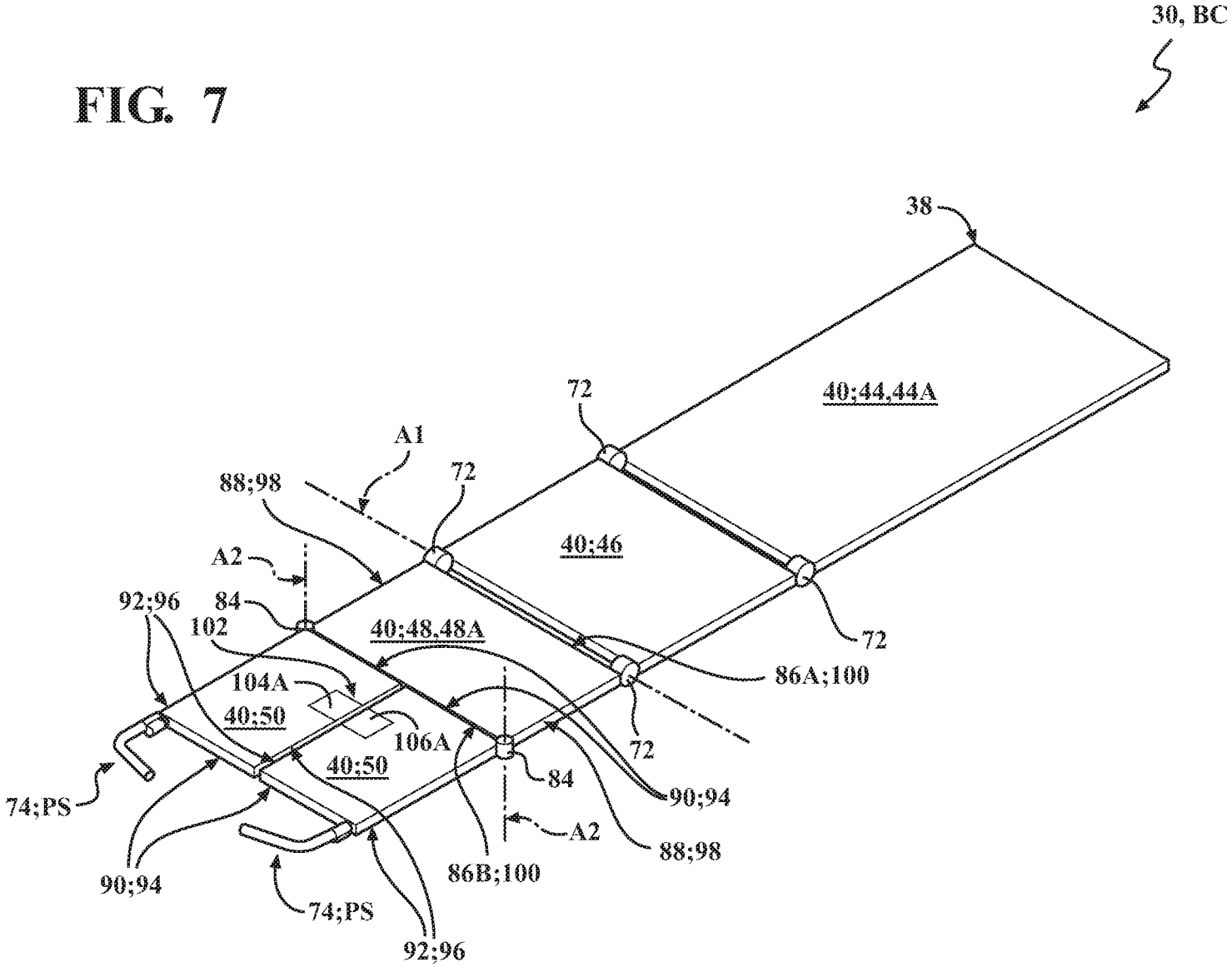
FIG. 7 is a perspective view of the patient support deck of the patient support apparatus of FIGS. 1-6, shown in the bed configuration to support the patient in a flat position as depicted in FIG. 1.
Figure 8:
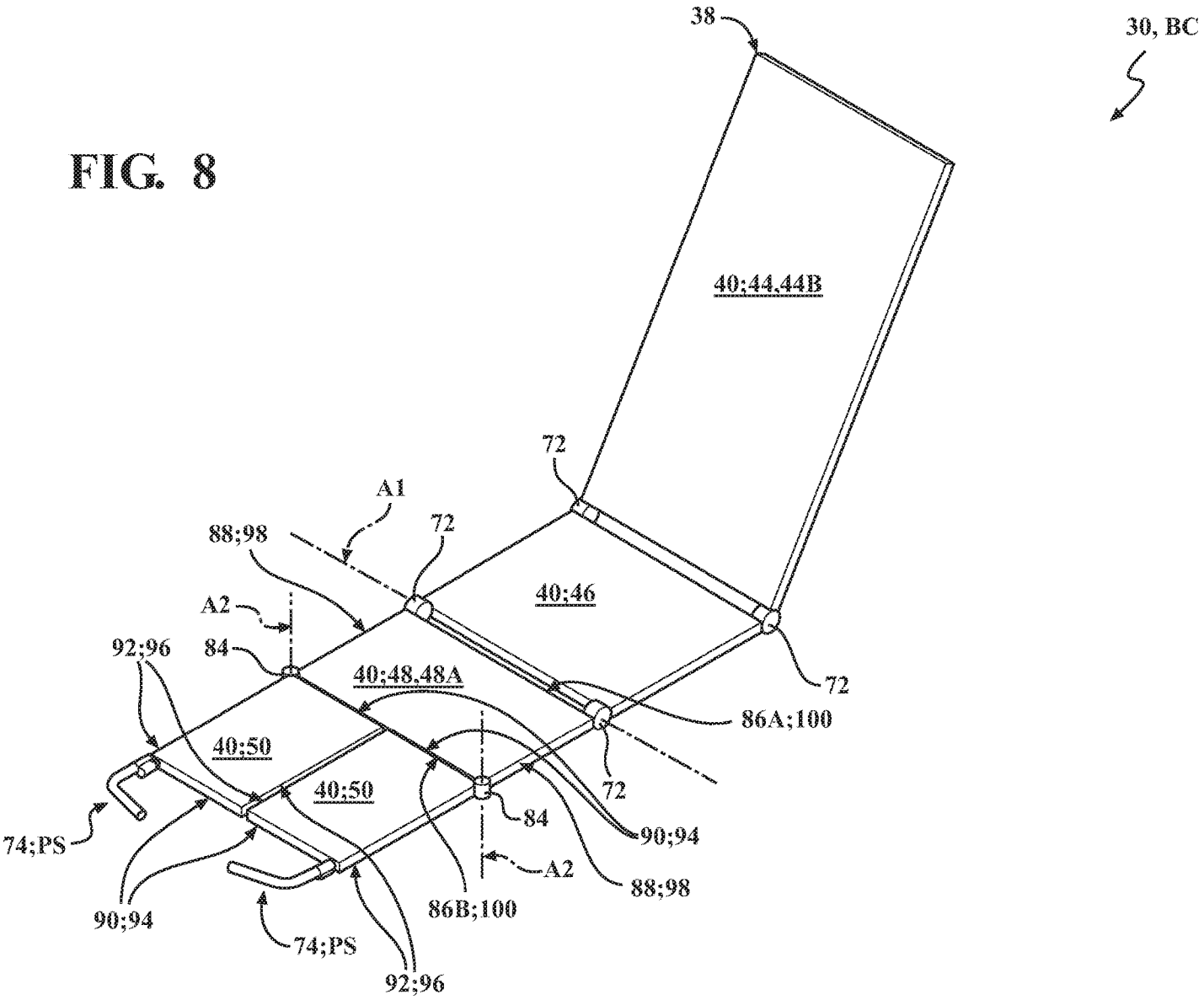
FIG. 8 is another perspective view of the patient support deck of FIG. 7, shown with the back section articulated to support the patient in the fowler position as depicted in FIG. 2.
Figure 9:
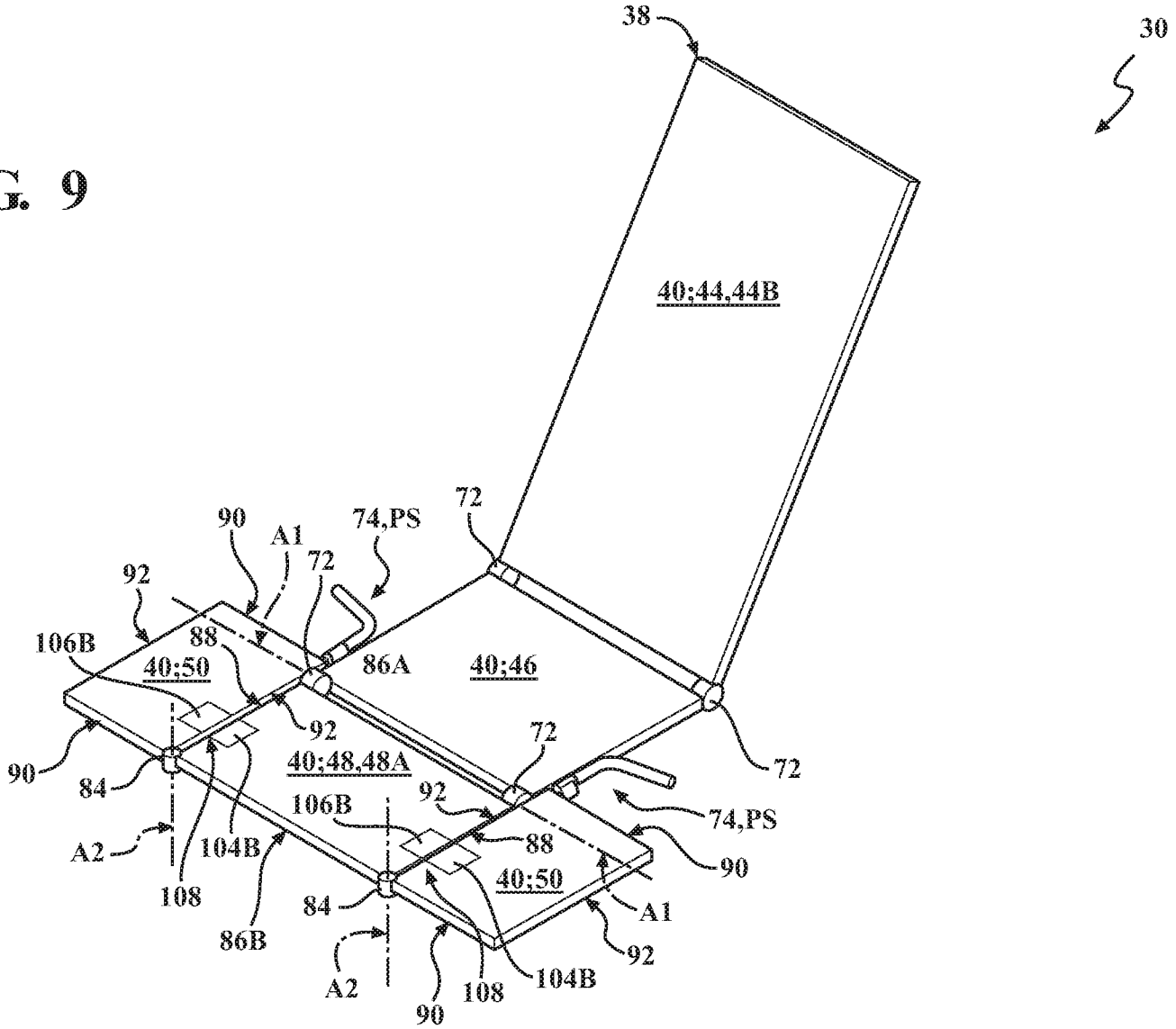
FIG. 9 is another perspective view of the patient support deck of FIGS. 7-8, shown with the foot sections articulated relative to the leg section as depicted in FIG. 4.

In the embodiment illustrated in FIGS. 7-12, the leg section 48 is arranged for articulation about a first axis A1 and the foot sections 50 are each arranged for articulation about respective second axes A2. The second axes A2 are each substantially perpendicular to the first axis A1, and are each spaced longitudinally from the first axis A1 (compare FIGS. 8, 9, and 10). As is depicted in FIGS. 7-9, the leg section 48 of the patient support deck 38 defines opposing first and second longitudinal leg sides 86A, 86B, and also defines opposing lateral leg sides 88. The first longitudinal leg side 86A faces toward the seat section 46, and the second longitudinal leg side 86B faces away from the seat section 46. The first axis A1 is arranged adjacent to the first longitudinal leg side 86A, and the second axes A2 are each arranged adjacent to the second longitudinal leg side 86B and to one of the opposing lateral leg sides 88. Put differently, the first axis A1 is spaced longitudinally from the second axes A2, and the second axes A2 are spaced laterally from each other.

Figure 10:
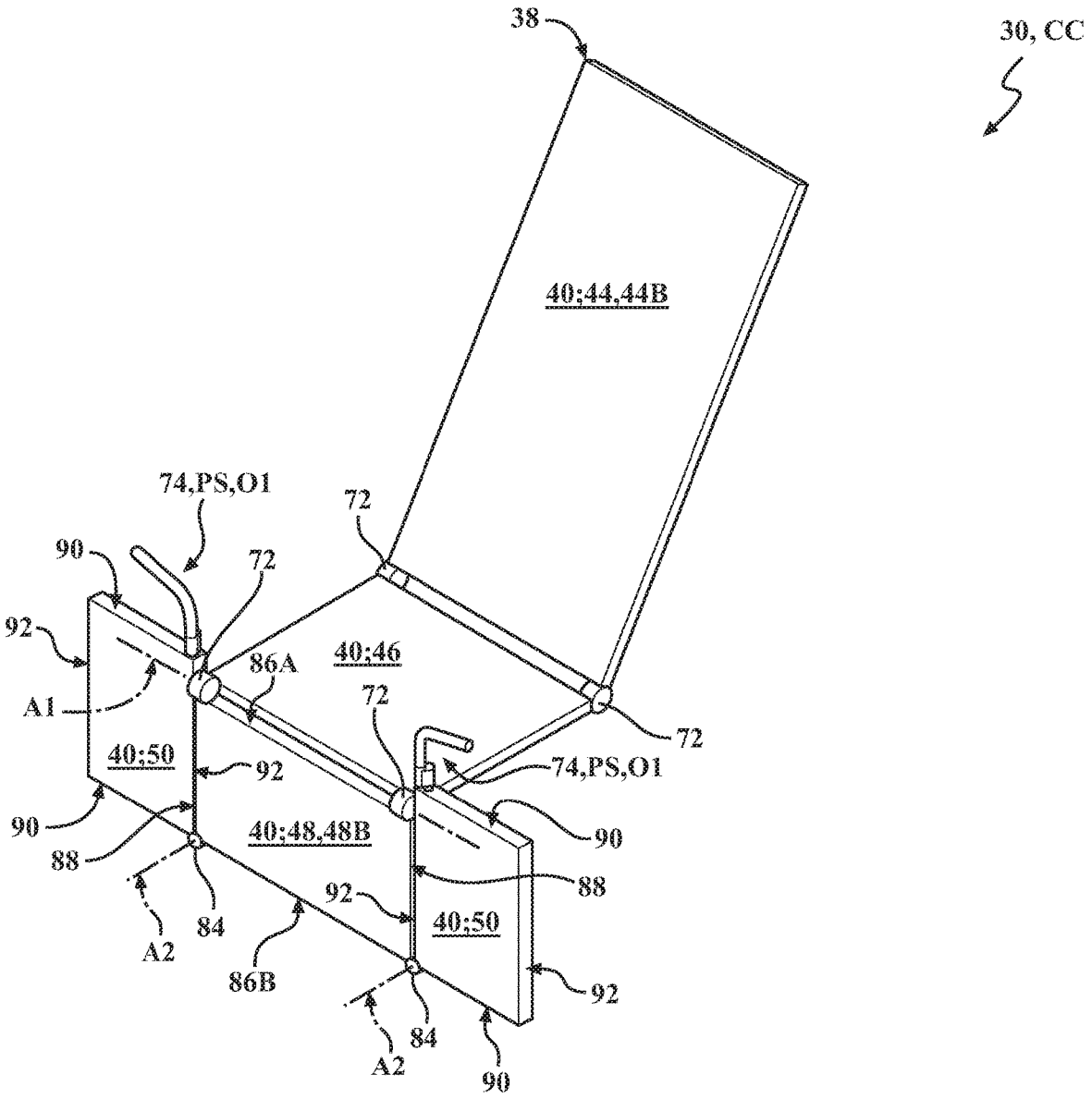
FIG. 10 is another perspective view of the patient support deck of FIGS. 7-9, shown in the chair configuration with the leg section and the foot sections articulated as depicted in FIG. 5, and depicting the handles in the stowed position.

The foot sections 50 each define respective opposing longitudinal foot sides 90 and opposing lateral foot sides 92. As shown in FIGS. 7-8, one of the longitudinal foot sides 90 of each of the foot sections 50 abuts one of the longitudinal leg sides 86A, 86B of the leg section 48 when the patient support deck 38 operates in the bed configuration BC. Conversely, as shown in FIGS. 10-12, one of the lateral foot sides 92 of each of the foot sections 50 abuts one of the lateral leg sides 88 of the leg section 48 when the patient support deck 38 operates in the chair configuration CC. Here too, when the patient support deck 38 is in the chair configuration CC, each of the lateral leg sides 88 of the leg section 48 abuts one of the lateral foot sides 92 of one of the foot sections 50. In the illustrated embodiment, the longitudinal foot sides 90 each define a respective longitudinal foot side area 94, and the lateral foot sides 92 each define a respective lateral foot side area 96 greater than the longitudinal foot side area 94. Further, the lateral leg sides 88 each define a respective lateral leg side area 98, and the longitudinal leg sides 86A, 86B each define a respective longitudinal leg side area 100 greater than the lateral leg side area 98. As noted above, other shapes and configurations of the foot sections 50 and/or the leg section 48 are contemplated.

It will be appreciated that the articulation of the leg section 48 and the foot sections 50 into the chair configuration CC described above affords significant opportunities in connection with patient ambulation by positioning the patient's feet on the floor surface F at a relatively low height. Specifically, because the foot sections 50 are articulated "up" and away from the floor surface F when the patient support apparatus 30 is in the chair configuration CC (see FIGS. 5-6), the longitudinal leg side 86B of the leg section 48 is able to be positioned significantly closer to the floor surface F than would otherwise be possible if the foot sections 50 were not articulated about the respective second axes A2. Put differently, because the foot sections 50 are not arranged between the leg section 48 and the floor surface F when the patient support apparatus 30 is in the chair configuration CC, the patient is able to place their feet on the floor surface F, without obstruction from the foot sections 50, at an advantageously low height suitable for ambulation.

In one embodiment, the patient support apparatus 30 comprises a retention mechanism, generally indicated at 102, arranged to keep the foot sections 50 in abutment with each other (see FIG. 7). To this end, the retention mechanism 102 comprises a catch element, indicated schematically at 104A, which is configured to releasably secure a corresponding latch element, indicated schematically at 106A. It will be appreciated that catch element 104A and the latch element 106A can be configured to releasably secure together in a number of different ways, such as via physical interlocking with the use of physical components or structural features, via magnetism with the use of permanent magnets, ferrous components, and/or electromagnets, and the like. As depicted in FIG. 7, the retention mechanism 102 is arranged between the foot sections 50 in the illustrated embodiment. However, it is contemplated that two retention mechanisms 102 could be provided (not shown), with one between each of the respective foot sections 50 and the leg section 48. Other configurations are contemplated. The patient support apparatus 30 may also comprise a pair of foot lock mechanisms, generally indicated at 108 in FIG. 9. The foot lock mechanisms 108, like the retention mechanism 102 described above, similarly comprise respective catch elements 104B and latch elements 106B which cooperate to releasably secure the respective articulated foot sections 50 to the leg section 48. Here too, it will be appreciated that the foot lock mechanism 108 could employ catch elements 104B and/or latch elements 106B of different types and configurations. Furthermore, those having ordinary skill in the art will appreciate that the retention mechanism 102 and/or the foot lock mechanism 108 could be configured to be manually-actuated and/or could be electronically controlled, such as via a controller (not shown).

In order to move the patient support apparatus 30 from the bed configuration BC to the chair configuration CC and facilitate ambulation via the handles 74, the back section 44 is moved, such as with one or more deck actuators 72, from the "flat" first back section position 33A (see FIGS. 1 and 7) to the "raised" second back section position 44B (see FIGS. 2 and 8). Next, the lift mechanism 64 is used to move the patient support deck 38, such as via the lift actuators 66, 68, from the "raised" first vertical configuration 38A (see FIG. 2) to the "lowered" second vertical configuration (see FIG. 3). At this point, the retention mechanism 102 can be released so as to allow the foot sections 50 to be articulated about their respective second axes A2 until they are subsequently secured, while articulated, via the foot lock mechanisms 108 (see FIGS. 4 and 9). Next, the leg section 48 can be articulated about the first axis A1, such as with one or more deck actuators 72, from the "flat" first leg section position 48A (see FIGS. 1-4 and 7-9) to the "lowered" second leg section position 48B (see FIGS. 5-6 and 10-12). At this point, the patient support apparatus 30 is in the chair configuration CC such that the patient can place their feet on the floor surface F (see FIGS. 5-6) in preparation for ambulation. Next, the handles 74 can be moved from the stowed position PS (see FIGS. 5 and 10) to the extended position PE (see FIGS. 6 and 11-12) to position handles 74 vertically further from the floor surface F. Next, the handles 74 can be rotated from the first orientation O1 (see FIG. 11) to the second orientation O2 (see FIG. 12) to position the hand grip portions 76 of the handles 74 for utilization by the patient, whereby the patient can utilize the handles 74 to transfer their weight from the patient support surface 42 to the floor surface F, thereby transitioning from sitting to standing and ambulating away from the patient support apparatus 30. However, as noted above, the first and second orientations O1, O2 could be defined in any suitable way and the handles 74 could be independently moved between the first and second orientations O1, O2. Moreover, depending on the specific configuration and/or shape of the handles 74, one or more of the handles 74 could be provided to facilitate patient ambulation without movement between the first and second orientations O1, O2.

Figure 13:
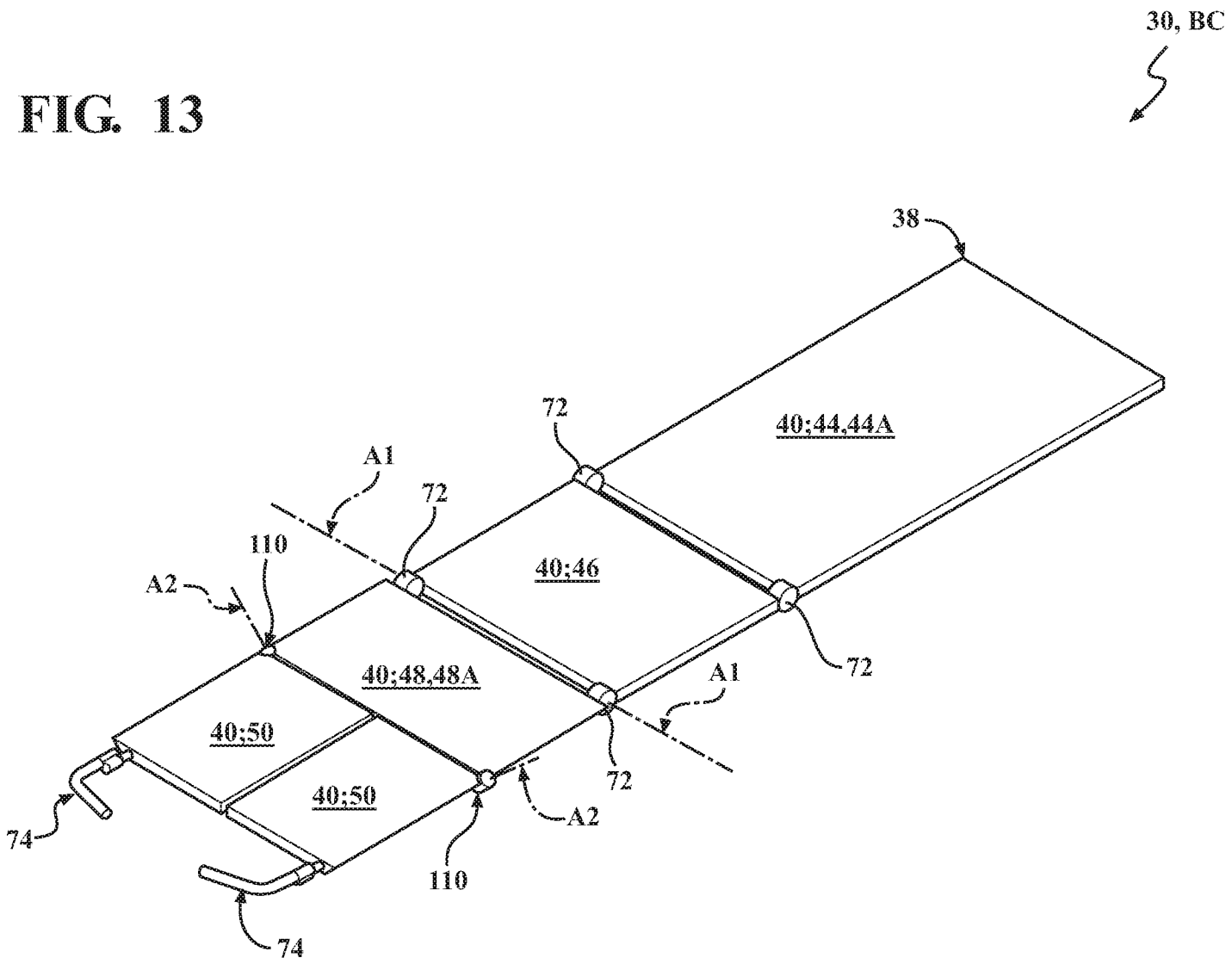
FIG. 13 is a perspective view of another embodiment of the patient support deck of FIG. 7, shown in the bed configuration to support the patient in a flat position as depicted in FIG. 1, and depicting compound pivot mechanisms disposed between the leg section and each of the foot sections.
Figure 14:
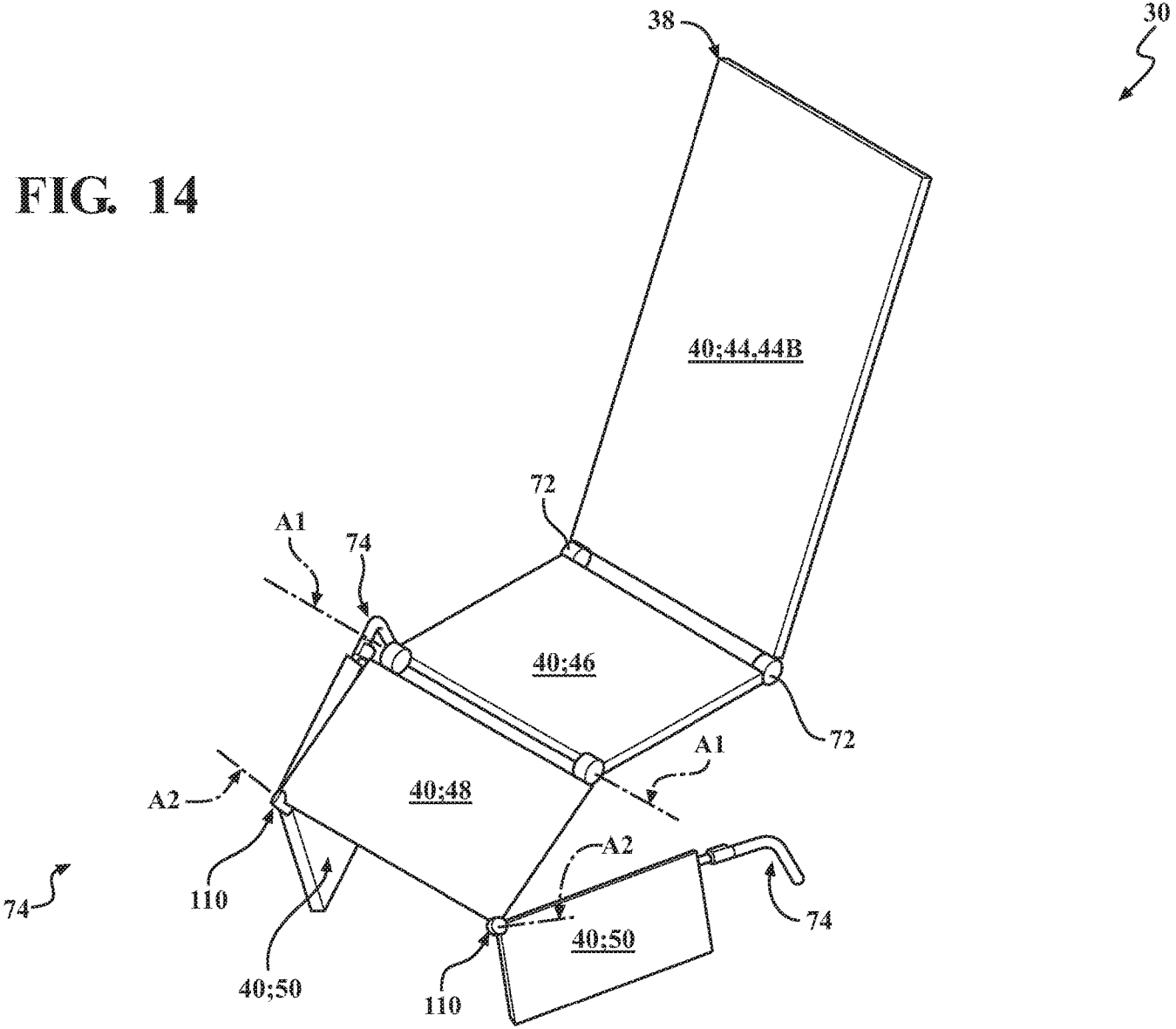
FIG. 14 is another perspective view of the embodiment of the patient support deck illustrated in FIG. 13, shown with the leg section and the foot sections articulated relative to the seat section.
Figure 15:
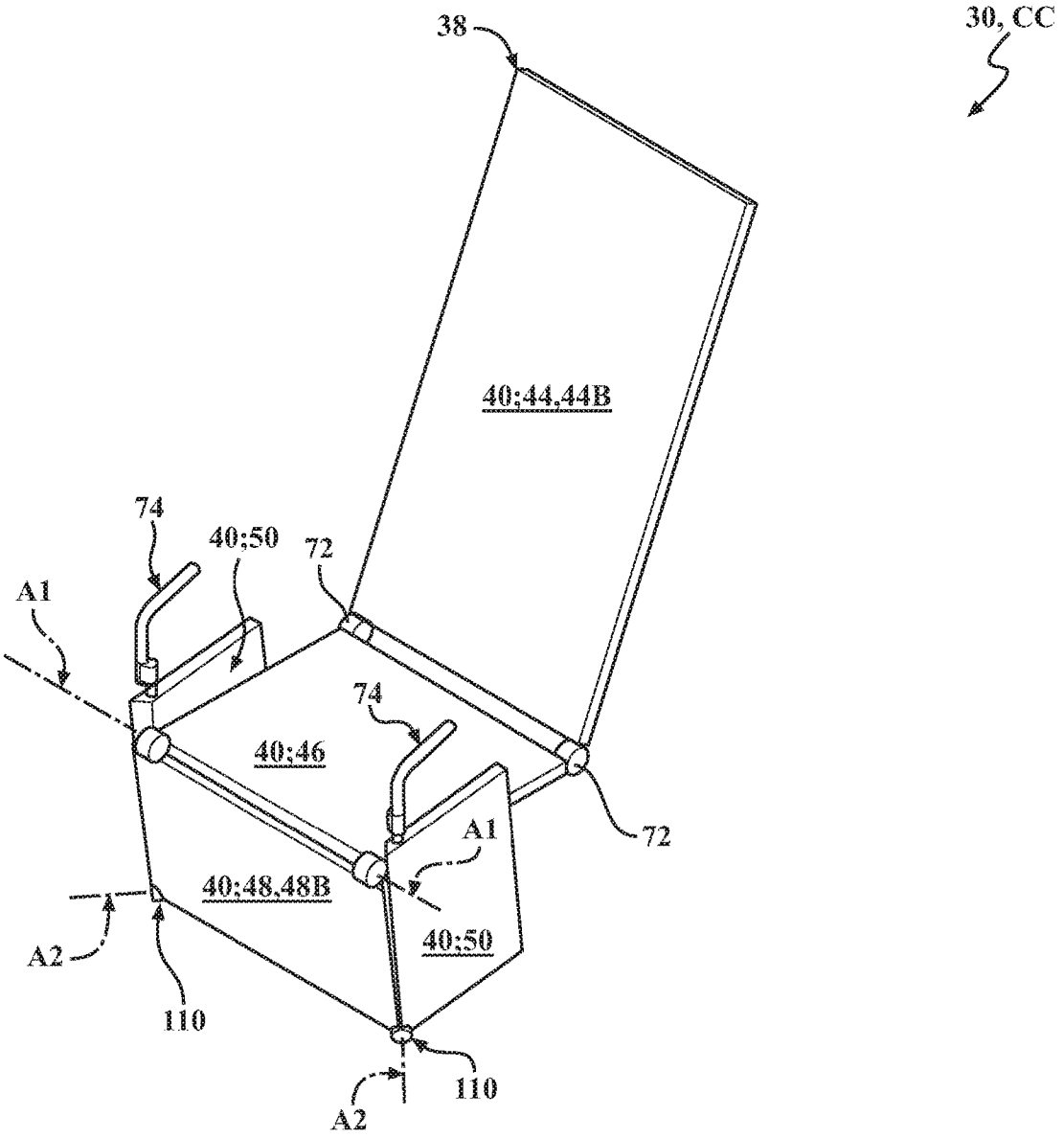
FIG. 15 is another perspective view of the embodiment of the patient support deck illustrated in FIGS. 13-14, shown in a chair configuration.

Referring now to FIGS. 13-15, another embodiment of the patient support apparatus 30 is shown. In this embodiment, as is described in greater detail below, the patient support deck 38 is configured to articulate from the bed configuration BC (see FIG. 13) to the chair configuration CC (see FIG. 15) differently than the previously-described embodiment illustrated in FIGS. 7-12. Here in this embodiment, when the patient support apparatus 30 is in the chair configuration CC, the foot sections 50 of the patient support deck 38 are articulated so as to reduce the overall lateral footprint of the patient support apparatus 30 in that the foot sections 50 are articulated laterally toward the seat section 46 (compare FIG. 15 to FIG. 12). In order to facilitate this articulation, the embodiment of the patient support apparatus 30 depicted in FIGS. 13-15 is provided with a pair of compound pivot mechanisms, generally indicated at 110, to respectively couple each of the foot sections 50 to the leg section 48 for articulation about the respective second axes A2. Here too in this embodiment, the second axes A2 are longitudinally spaced from the first axis A1 (compare FIG. 13 to FIG. 7), but are arranged substantially oblique to the first axis A1. Put differently, the second axes A2 are arranged non-perpendicularly to the first axis A1 in the embodiment illustrated in FIGS. 13-15. This configuration helps facilitate concurrent articulation of the leg section 48 about the first axis A1 and articulation of the foot sections 50 about the respective second axes A2 (see FIG. 14) when the patient support apparatus 30 is moved from the bed configuration BC (see FIG. 13) to the chair configuration CC (see FIG. 15). While the previously-described embodiment illustrated in FIGS. 7-12 can also be configured to facilitate concurrent articulation of the leg section 48 and the foot sections 50 as opposed to sequential articulation of the foot sections 50 and the leg section 48, it will be appreciated that the utilization of the compound pivot mechanisms 110 may be advantageous for certain applications, such as where the patient support apparatus 30 is utilized in a confined area.

In the embodiment illustrated in FIGS. 13-15, the leg section 48 and the foot sections 50 each have a generally trapezoidal profile, and compound pivot mechanisms 110 are realized as "hinges" arranged to orient the second axes A2 approximately 45-degrees in the lateral direction (see FIG. 13), rather than being perpendicular to the first axis A1 (see FIGS. 7-12). Here too, it will be appreciated that the compound pivot mechanisms 110 could be manually-actuated or could be powered, such as with rotary actuators. While the compound pivot mechanisms 110 illustrated in FIGS. 13-15 are each arranged to facilitate articulation about a single respective second axis A2, it will be appreciated that the compound pivot mechanisms 110 could be configured to facilitate articulation about multiple axes and/or in multiple directions. By way of non-limiting example, each compound pivot mechanism 110 could be configured to facilitate articulation about two respective axes arranged perpendicular to each other (not shown). Similarly, each compound pivot mechanism 110 could be configured to facilitate rotation about a point in multiple directions, such as with a "ball and socket" pivot arrangement. Other configurations are contemplated.

In this way, the embodiments of the patient support apparatus 30 of the present disclosure afford significant opportunities for promoting patient ambulation from the patient support surface 42 to the floor surface F. Specifically, it will be appreciated that the arrangement of the handles 74, the foot sections 50, and the leg section 48 allows the patient to grip the handles 74 and ambulate from the seated position SP to the floor surface F while the patient support deck 38 is in the chair configuration CC. Furthermore, because the handles 74 and the foot sections 50 move concurrently and articulate relative to the leg section 48 about the second axes A2, the configuration of the patient support apparatus 30 allows the patient to be supported in the flat position FP when the patient support deck 38 is in the bed configuration BC while, at the same time, positioning the handles 74 away from the patient support surface 42. Thus, the patient support apparatus 30 can be manufactured in a cost-effective manner while, at the same time, affording opportunities for improved functionality, features, and usability in connection with patient ambulation and mobility.

It will be further appreciated that the terms "include," "includes," and "including" have the same meaning as the terms "comprise," "comprises," and "comprising." Moreover, it will be appreciated that terms such as "first," "second," "third," and the like are used herein to differentiate certain structural features and components for the non-limiting, illustrative purposes of clarity and consistency.

Several configurations have been discussed in the foregoing description. However, the configurations discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

The invention is intended to be defined in the independent claims, with specific features laid out in the dependent claims, wherein the subject-matter of a claim dependent from one independent claim can also be implemented in connection with another independent claim.

What is claimed is:

1. A patient support apparatus for use in ambulating a patient to a floor surface, said patient support apparatus comprising:

a base;

a patient support deck operatively attached to said base and having a seat section, a leg section, and a pair of foot sections, said patient support deck being operable between:

a bed configuration where said seat section, said leg section, and each of said foot sections cooperate to support the patient in a flat position, and a chair configuration where said seat section supports the patient in a seated position, where said leg section is articulated adjacent to the floor surface, and where said foot sections are articulated relative to said leg section out of support of the patient; and a handle to facilitate patient ambulation, said handle being coupled to one of said foot sections of said patient support deck with said handle being arranged to facilitate patient ambulation when said patient support deck is in said chair configuration.

2. The patient support apparatus as set forth in claim 1, wherein said handle comprises a hand grip portion, a mount portion coupled to said foot section, and a body portion extending between said hand grip portion and said mount portion.

3. The patient support apparatus as set forth in claim 2, wherein said body portion of said handle comprises a telescoping mechanism configured to move said hand grip portion relative to said mount portion between a stowed position and an extended position.

4. The patient support apparatus as set forth in claim 1, wherein said foot sections are each substantially parallel to said leg section.

5. The patient support apparatus as set forth in claim 1, further comprising a pair of foot hinge mechanisms each coupled to said leg section and to one of said foot sections to facilitate articulation relative to said leg section.

6. The patient support apparatus as set forth in claim 1, wherein said leg section is arranged for articulation about a first axis and said foot sections are arranged for articulation about respective second axes; and wherein said leg section defines opposing first and second longitudinal leg sides, with said first axis arranged adjacent to said first longitudinal leg side, and with said second axes each arranged adjacent to said second longitudinal leg side.

7. The patient support apparatus as set forth in claim 6, wherein said second axes are each substantially perpendicular to said first axis.

8. The patient support apparatus as set forth in claim 6, wherein said second axes are each spaced longitudinally from said first axis.

9. The patient support apparatus as set forth in claim 6, wherein said leg section further defines opposing lateral leg sides, with each of said second axes respectively arranged adjacent to one of said lateral leg sides.

10. The patient support apparatus as set forth in claim 1, wherein said leg section defines opposing longitudinal leg sides and opposing lateral leg sides;

wherein said foot sections each define respective opposing longitudinal foot sides and opposing lateral foot sides;

wherein one of said longitudinal foot sides of each of said foot sections abuts one of said longitudinal leg sides of said leg section when said patient support deck operates in said bed configuration; and wherein one of said lateral foot sides of each of said foot sections abuts one of said lateral leg sides of said leg section when said patient support deck operates in said chair configuration.

11. The patient support apparatus as set forth in claim 10, wherein each of said lateral leg sides of said leg section respectively abuts one of said lateral foot sides of one of said foot sections when said patient support deck operates in said chair configuration.

12. The patient support apparatus as set forth in claim 10, wherein said longitudinal foot sides each define a respective longitudinal foot side area, and said lateral foot sides each define a respective lateral foot side area greater than said longitudinal foot side area.

13. The patient support apparatus as set forth in claim 12, wherein said lateral leg sides each define a respective lateral leg side area, and said longitudinal leg sides each define a respective longitudinal leg side area greater than said lateral leg side area.

14. The patient support apparatus as set forth in claim 1, comprising a pair of handles to facilitate patient ambulation, each of said handles being respectively coupled to one of said foot sections of said patient support deck with each of said handles arranged to facilitate patient ambulation when said patient support deck is in said chair configuration.

15. The patient support apparatus as set forth in claim 1, wherein said leg section is arranged for articulation about a first axis and said foot sections are arranged for articulation about respective second axes; and further comprising a pair of compound pivot mechanisms to respectively couple each of said foot sections to said leg section for articulation about said respective second axes.

16. The patient support apparatus as set forth in claim 15, wherein said second axes are each spaced longitudinally from said first axis and are arranged substantially oblique to said first axis.

17. A patient support apparatus for use in ambulating a patient to a floor surface, said patient support apparatus comprising:

a base;

a patient support deck operatively attached to said base and having a seat section and a pair of foot sections, said patient support deck being operable between:

a bed configuration where said seat section and each of said foot sections cooperate to support the patient in a flat position, and a chair configuration where said seat section supports the patient in a seated position and where said foot sections are articulated out of support of the patient; and a handle to facilitate patient ambulation, said handle being coupled to one of said foot sections of said patient support deck with said handle being arranged to facilitate patient ambulation when said patient support deck is in said chair configuration.

18. The patient support apparatus as set forth in claim 17, wherein said handle comprises a hand grip portion, a mount portion coupled to said foot section, and a body portion extending between said hand grip portion and said mount portion.

19. The patient support apparatus as set forth in claim 18, wherein said body portion of said handle comprises a telescoping mechanism configured to move said hand grip portion relative to said mount portion between a stowed position and an extended position.

20. The patient support apparatus as set forth in claim 17, comprising a pair of handles to facilitate patient ambulation, each of said handles being respectively coupled to one of said foot sections of said patient support deck with each of said handles arranged to facilitate patient ambulation when said patient support deck is in said chair configuration.

* * * * *